US006140984A

United States Patent [19]

Kanazawa et al.

[11] Patent Number: 6,140,984

[45] **Date of Patent: *Oct. 31, 2000**

[54] METHOD OF OPERATING A PLASMA DISPLAY PANEL AND A PLASMA DISPLAY DEVICE USING SUCH A METHOD

[75] Inventors: Yoshikazu Kanazawa; Tomokatsu Kishi, both of Kawasaki, Japan

[73] Assignee: Fujitsu Limited, Kawasaki, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/695,061

[22] Filed: Aug. 2, 1996

[30] Foreign Application Priority Data

May 17, 1996 [JP] Japan ..... 8-123658

[51] Int. Cl.[7] ..... G09G 3/28

[52] U.S. Cl. ..... 345/67; 345/66; 345/68; 315/169.4

[58] Field of Search ..... 345/60, 67, 68, 345/66; 315/169.1, 169.4

[56] References Cited

U.S. PATENT DOCUMENTS

| | | | |
|---|---|---|---|
| 4,554,537 | 11/1985 | Dick | 345/67 |
| 4,638,218 | 1/1987 | Shinoda et al. | 315/169.4 |
| 4,728,864 | 3/1988 | Dick | 315/169.3 |
| 5,369,338 | 11/1994 | Kim | 315/169.4 |
| 5,436,634 | 7/1995 | Kanazawa | 345/67 |
| 5,821,912 | 10/1998 | Miyazaki | 345/60 |

FOREIGN PATENT DOCUMENTS

| | | |
|---|---|---|
| 0157248 | 3/1985 | European Pat. Off. . |
| 0 657 861 | 6/1995 | European Pat. Off. . |

*Primary Examiner*—Dennis-Doon Chow
*Assistant Examiner*—Amr Awad
*Attorney, Agent, or Firm*—Staas & Halsey LLP

[57] ABSTRACT

The address discharge in a plasma display device provided with a triple-electrode surface-discharge AC plasma display panel is controlled such that a potential difference occurring across a discharge slit between first and second electrodes selected for display is smaller than a potential difference occurring across a non-discharge slit between the first electrode not selected for display and the second electrode selected for display.

35 Claims, 26 Drawing Sheets

METHOD OF OPERATING A PLASMA DISPLAY PANEL AND A PLASMA DISPLAY DEVICE USING SUCH A METHOD

BACKGROUND OF THE INVENTION

1. Field of the Invention

The present invention generally relates to a method of operating a plasma display panel and a display device using such a method. More particularly, the present invention relates to a method of operating a plasma display panel constructed by a set of cells (display elements) each having a memory function, and a plasma display device using such a method. Specifically, the present invention concerns an operating method for writing display data in an AC plasma display panel, and a plasma display device in which such an operating method is used.

In an AC plasma display panel, an alternating voltage is applied between two sustain electrodes so that a discharge is sustained and illuminated display is effected. A cycle of discharge ends 1- to 10-$\mu$s after a pulse is applied. Ions (positive charges) created by the discharge are collected on the surface of an insulating layer on the electrode to which a negative voltage is applied. Electrons (negative charges) are collected on the surface of an insulating layer on the electrode to which a positive voltage is applied.

After a pulse (write pulse) having a relatively high voltage (write voltage) is applied so that a write discharge is performed and wall charges are formed, a pulse (sustain pulse) having an opposite polarity and having a relatively low voltage (sustain discharge voltage) is applied. Charges created by applying the sustain pulse are superimposed on the wall charges. As a result, the voltage with respect to the ambient space grows to exceed a threshold voltage so that a discharge occurs. To summarize the above, once the write discharge is performed so that the wall charges are created, the discharge is sustained by applying alternating sustain pulses. This phenomenon is referred to as a memory effect or a memory function. In general, the AC plasma display panel displays by utilizing the memory effect.

A cell in which a discharge takes place is separated from the adjacent cells by ribs or barriers. Ribs or barriers may be provided to surround on all four sides a cell in which a discharge takes place. Alternatively, a rib or a barrier may be provided to cover one of the four sides of the cell so that, on the remaining three sides, the cell is separated from the adjacent cells by optimizing gaps between electrodes.

The present invention provides a surface-discharge AC plasma display panel using three electrodes in a cell. The technology provided by the present invention is most suitably used when the write discharge (address discharge) for selection of a cell in correspondence with display data is performed in a panel constructed such that a barrier is provided to cover only one of the four sides of the cell. The technology described hereinafter is particularly useful to advance the development of high-brightness, high-precision and large-scale display panel.

2. Description of the Related Art

Two types of conventional AC plasma display panels are known: a dual-electrode plasma display panel in which two electrodes are used to perform an address discharge and a sustain discharge; and a triple-electrode plasma display panel in which three electrodes are used to perform the address discharge. In a dual-electrode plasma display panel used as a color display panel capable of display gradations, a fluorescent body (phosphor) formed in a cell is excited by an ultraviolet ray created by the discharge. Since positive ions generated in the discharge directly impinges upon the fluorescent body susceptible to impact of positive ions, the life of the fluorescent body is relatively rapidly exhausted.

For this reason, a triple-electrode surface-discharge AC plasma display panel is normally used as a color display panel. A triple-electrode surface-discharge AC plasma display panel may be constructed such that a third electrode is formed on the same substrate on which first and second electrodes selected for the sustain discharge are formed. Alternatively, the triple-electrode surface-discharge AC display panel may be constructed such that a third electrode is formed on a separate substrate facing the substrate on which the first and second electrodes are formed.

The plasma display panel in which the three electrodes are formed on the same substrate may be constructed such that the third electrode is provided above the two electrodes for the sustain discharge. Alternatively, the third electrode may be formed below the two electrodes for the sustain discharge.

According to another classification, a plasma display panel may be a transparent plasma display panel constructed such that visible light emitted and transmitted by the fluorescent body is observed human eyes. A reflection plasma display panel is constructed such that the reflection from the fluorescent body is observed.

A description will now be given of a conventional reflection triple-electrode surface-discharge AC plasma display panel in which the third electrode is formed on a substrate facing the substrate on which the electrodes for the sustain discharge are formed, ribs are formed only in an orthogonal direction (that is, in a direction perpendicular to the direction in which the sustain electrodes lie and parallel to the direction in which the third electrode lies), and each of the sustain electrodes is formed in part by a transparent electrode.

FIG. 1 shows such a conventional reflection triple-electrode surface-discharge AC plasma display panel 2. FIG. 2 shows another triple-electrode surface-discharge AC plasma display panel 2 which is an elaboration of the panel of FIG. 1 in that the disposition of the electrodes is improved so that the capacitance between electrodes is reduced. FIG. 3 is a sectional view of the triple-electrode surface-discharge AC plasma display panel of FIGS. 1 and 2 taken along the direction in which the third electrodes lie. FIG. 4 is a sectional view of the plasma display panel of FIGS. 1 and 2 taken along the direction in which the sustain electrodes lie.

As shown in FIGS. 3 and 4, the triple-electrode surface-discharge AC plasma display panel of FIGS. 1 and 2 includes two glass substrates (more specifically, a rear glass substrate and a front glass substrate).

A first electrode 207 (specifically, X electrode) and a second electrode 208 (specifically, Y electrode) are formed in the front glass substrate 205 with a separation of a discharge slit (that is, a gap between the X electrode 207 and the Y electrode 208 set to about 100 $\mu$m). A pair formed by the first electrode 207 and the second electrode 208 constitutes a sustain electrode. Each of these electrodes 207, 208 is composed by a transparent electrode 207A and a bus electrode 207B. The transparent electrode 207A lets a reflected beam 207H from a fluorescent body 207 to pass therethrough. The bus electrode 207B is provided to prevent a voltage drop by an electrode resistance. In addition, the electrodes are coated by a dielectric layer 207C and a MgO (magnesium oxide) film 207D is formed on the discharge side as a protective film. Moreover, a third electrode (address electrode) 209 is formed in the second substrate 206 (specifically, the rear glass substrate 206) opposite to front glass substrate 205 so as to be orthogonal to the first electrode 207. Moreover, a barrier 207E is formed between the address electrodes 209 protected with a dielectric 207G. A fluorescent body 207F with a red, green, blue luminescence characteristic is formed so as to cover the address electrode 209 between the barriers 207E. The rear glass substrate 206 and the front glass substrate 205 are assembled such that a ridge of the barrier 207E and the MgO film 207D are in close contact with each other. Moreover, when the discharge slit between the first electrode 207 and the second electrode 208 which form the pair is set to 100 μm, a non-discharge slit which is a gap between two adjacent sustain electrodes in the respective display lines is set to 300 μm. The width of the sustain electrode is set to about 250 μm.

FIG. 5 is a block diagram of a conventional plasma display device 9 where a peripheral circuit to drive the plasma display panel of FIG. 1 and FIG. 2 is provided. An address pulse for the address discharge is applied to the address electrode 209 using an address driver 28 connected to each of address electrode 209 in the plasma display device 9. The address driver 28 is controlled by a control circuit 281. Moreover, the Y electrode 208 is individually connected to a scan driver 27 (Y scan driver 27).

The Y scan driver 27 is connected to a Y-side common driver 22. The pulse for the address discharge is generated by the scan driver 27. The sustain pulse etc. are generated by the Y-side common driver 22. These pulses are applied to the Y electrode 208 via the Y scan driver 27. The Y-side common driver 22 is controlled by a common driver control unit 221 provided in a panel operation control unit 281A. The Y scan driver 27 is controlled by a scan driver control unit 271 provided in the panel operation control unit 281A.

The X electrode 207 is connected together in the entire display lines 201 of a plasma display panel 2. A X-side common driver 22 (not shown) generates the write pulse, the sustain pulse, etc. and is controlled by the common driver control unit 221. The common driver control unit 221, the scan driver control unit 271, and the control circuit 281 are controlled with a vertical sync signal (VSYNC in FIG. 5) and a horizontal sync signal (HSYNC in FIG. 5) input from outside the device to the panel operation control unit 281A, and with a display data signal (DATA in FIG. 5) and a dot clock (CLOCK in FIG. 5) input to a display data control unit 281B. The display data signal DATA input according to the dot clock CLOCK is stored in a frame memory 281B-1.

FIG. 6 is a waveform chart which shows a conventional method of operating the plasma display panel 2 shown in FIGS. 1–4 with the circuit shown in FIG. 5. The chart illustrates one sub-field period in the separated address period/sustain discharge period write addressing.

One sub-field in the conventional method is divided into a reset period, an address period, and a sustain discharge period. All the Y electrodes 208 are first set at a 0 V level and an whole-screen write pulse of a Vs+Vw (specifically, about 300 V) is applied to the X electrodes 207 at the same time for the reset period. The discharge is caused in all cells of all the display lines 201 regardless of the previous state of the display. A potential Vaw of the address electrode 209 at this time is about 100 V. Next, the potential of the X electrode 207 and the address electrode 209 becomes 0 V. In all cells, the voltage due to a wall charge 204 exceeds a discharge-initiating (firing) voltage and the discharge is begun. The space charge is self-neutralized and the discharge ends, since this discharge does not involve the potential difference between the electrodes. That is, a so-called self-erase discharge occurs. All cells in the panel enters a uniform state without the wall charge 204 built up, as a result of this self-erase discharge. The resetting has an action by which all cells are in the same state regardless of the previous state of the sub-field. As a result, it is possible to perform a subsequent address discharge (that is, the writing) in a stable manner.

Next, the line sequential address discharge is caused in the address period according to the display data to control the activating of the cell. FIGS. 7A–7C show the mechanism of this address discharge.

A scan pulse 21 at a −VY level (specifically, about −150 V) is applied to the Y electrode 208. An address pulse of a voltage Va (specifically, about 50 V) is selectively applied to address electrode 209 corresponding to the cell which is activated for illumination, that is the cell which is a target for the sustain discharge. The discharge occurs between the address electrode 209 and the Y electrode 208 of the cell which is lighted (see FIG. 7A). Next, this discharge triggers the discharge between the X electrode 207 and the Y electrode 208 as a priming discharge (see FIG. 7B). As a result, the wall charge 204 of an amount by which the sustain discharge is enabled is collected on the MgO film 207D on the X electrode 207 and the Y electrode 208 of the selected line 202 (see FIG. 7C). A similar operation is executed one by one for the other display lines 201. In all the display lines 201, new display data is written. Afterwards, in the sustain discharge period, the sustain pulse having a voltage of Vs (about 180 V) is alternately applied to the Y electrode 208 and the X electrode 207 so that the sustain discharge is caused. The image of one sub-field field is displayed. In this "separated address period/sustain discharge period write addressing", the duration of the sustain discharge period determines the brightness. That is, the brightness depends on the frequency of the sustain pulse (voltage Vs).

FIG. 8 is a time chart showing the sequence of the separated address period/sustain discharge period write addressing of FIG. 6.

In the separated address period/sustain discharge period write addressing, one frame is divided into eight sub-fields SF8 SF1, SF2, SF3, SF4, SF5, SF6, and SF7. In these sub-fields SF1–SF8, the reset period and the address period have the same duration. Moreover, the ratio of the durations of the sustain discharge period is 1:2:4:8:16:32:64:128. Therefore, by selecting the sub-field to be lighted, it is possible to display the brightness of 256 steps from 0 to 255. That is, a 256-step gradation display is enabled.

Specifically, one frame has the duration of 16.6 ms (1/60 Hz) assuming that the cycle of rewriting the screen is 60 Hz. Moreover, when the pulse frequency in one frame of the sustain discharge (referred to as the sustain cycle) is assumed to be 510 times per frame, 2 cycles occur in the sub-field SF1, 4 cycles occur in the sub-field SF2, 8 cycles occur in the sub-field SF3, 16 cycles occur in the sub-field SF4, 32 cycles occur in the sub-field SF5, 64 cycles occur in the sub-field SF6, 128 cycles occur in the sub-field SF7, and 256 cycles occur in the sub-field SF8. When duration of the sustain cycle is assumed to be 8 ms, the total duration in one frame becomes 4.08 ms. About 12 ms of the remainder is allocated for the eight reset periods, address periods, and stop periods. Therefore, the reset period and the address period of each sub-field have the duration of about 1.5 ms. When it is assumed that about 50 ms is necessary for the reset period of each address period, the address cycle becomes 3 ms to drive the panel of 500 lines.

However, high-brightness, high-resolution, and large scale design can be achieved in the plasma display device 9 which uses the above-described conventional method, by connecting the X electrode 207 with a common bus to provide an easy leading out of the panel electrode to the circuit side and the simplification of the circuit. As a result, though the Y electrode 208 and the address electrode 209 are fed the selection potential or the non-selection potential, no stable operation is enabled because the X electrode 207 is connected to the common bus.

A further explanation will now be given of the problem in making a high-resolution plasma display device 9 which uses a conventional method of operating a plasma display panel. The explanation will be given based on the construction of the plasma display panel 2 shown in FIGS. 1–4. It is to be noted that raising the brightness by raising the frequency of lighting has a limitation in terms of the power consumption, the time distribution and the life of the device. Hence, it is necessary to raise the lighting efficiency.

One method of raising the lighting efficiency is to allow the discharge to be conducted within a wide range and to positively activate the discharge. Narrowing the discharge slit (that is, the gap between the transparent electrode 207A of the X electrode 207 and the Y electrode 208) to only a limited degree and enlarging the width of the transparent electrode 207A are advantageous to allow the discharge to be conducted within a wide range. Another method is to increase the numerical aperture so that the beam generated in the fluorescent body 207F is led to the surface without much disturbance. In the case of the reflection device, it is desirable that the width of the bus electrode 207B be relatively small because the bus electrode 207B presents an obstruction to the reflected beam 207H. However, the resistance element of the electrode is increased when the width of the bus electrode 207B is narrowed too much, increasing the voltage drop when the discharge current flows. As a result, the voltage applied to the cell decreases, the activation of the discharge is disturbed consequently, decreasing the brightness. Moreover, the amount of the voltage drop depends on the magnitude of a display area. Therefore, a change in the magnitude of the display area brings about a change in the brightness, significantly reducing the display quality occasionally.

Considering above-mentioned point, it is preferable to enlarge the width of the transparent electrode 207A and to narrow the bus electrode 207B only to a limited degree. As a result, the non-discharge slit on the reverse side with respect to the discharge slit will become narrow under a given size of the cell. When the non-discharge slit is too narrow, the discharge-initiating voltage for the discharge slit and that for the non-discharge slit approaches (the discharge-initiating voltage is determined depending on the product of the distance and the gas pressure between the electrodes as well as on the composition of the enclosed gas, the dielectric substance material, and the quality of MgO film 207D), so that the cells are prevented from being properly separated from each other. There is known a plasma display panel in which the stripe barrier 207E is formed in the non-discharge slit so as to separate the cells (that is, the discharge space) properly.

Providing the stripe barrier 207E in the non-discharge slit prevents making of a plasma display panel 2 of high resolution and will make it difficult to manufacture the plasma display panel 2 with precision. The barrier 207E is often formed with the thick-film print technology (screen print technology) and the sand blasting. Providing the stripe barrier 207E of a width on the order of 10–100 $\mu$m and a height on the order of 100–200 $\mu$m is very difficult compared with providing the barrier 207E only in one direction. Moreover, the accuracy required when front glass substrate 205 carrying the first electrode 207 and the rear glass substrates 206 carrying the address electrode 209 are attached to each other can be less strict so that the high resolution can be achieved if the stripe barrier 207E is provided only in one direction than the accuracy required when the stripe barrier 207E is provided.

In addition, when the high resolution is intended, this stripe barrier 207E is a factor making the process for manufacturing the plasma display panel 2 more difficult Moreover, even if the stripe barrier 207E is not provided, it is necessary to narrow the non-discharge slit if the high resolution is intended. In the plasma display panel 2 characterized by a narrow non-discharge slit, the space charge freely extends to the space in the vertical direction, and an unnecessary effect of the priming is generated for the cells adjoining in the vertical direction, resulting in unnecessary collection of the wall charge 204. As a result, an improper discharge (mis-addressing) is generated. Such a phenomenon is called a vertical connection.

Next, the generation mechanism of the vertical connection is explained with reference to FIGS. 7A–7C. The address discharge to select the display cell is caused by giving the voltage of less than the minimum discharge-initiating voltage and more than the minimum sustain discharge voltage to the X electrode 207 and the Y electrode 208, and by giving, to the address electrode 209 forming the cell to be selected, the address pulse (voltage Va) of a level by which the potential difference with respect to the Y electrode 208 exceeds the discharge-initiating voltage between the address electrode 209 and the Y electrode 208.

The voltage of VX (50 V) is applied to the X electrode 207 as shown in FIGS. 7A–7C. Moreover, the scan pulse 21 of the selection potential −VY (−150 V) is applied to the Y electrode 208. At this time, the address pulse of Va (50 V) (voltage Va) is applied to the address electrode 209 of the cell selected for the discharge so that the discharge is begun. Here, when the discharge-initiating voltage between the address electrode 209 and the Y electrode 208 is assumed to be VfAY, the relation of $VfAY \leqq Va+VY$ (=200 V) exists. Moreover, when the minimum sustain discharge voltage between the X electrode 207 and the Y electrode 208 is assumed to be Vsm and the discharge-initiating voltage between the X electrode 207 and the Y electrode 208 is assumed to be Vf, the relation of $Vsm \leqq VX+VY$ (200 V)$<Vf$ exists.

The discharge begun between the address electrode 209 and the Y electrode 208 (the first step) triggers and activates the discharge between the X electrode 207 and the Y electrode 208 (the second step). When the discharge is settled in the final (the 3rd) stage, the negative wall charge 204 is collected on the X electrode 207 side, the positive wall charge 204 is collected on the Y electrode 208 side, and the negative wall charge 204 is collected on the address electrode 209 side, respectively.

Next, a description will now be given of an influence on the adjacent lines. FIGS. 9 through 12 are referred to for an explanation of the influence on the adjacent cells occurring in the address discharge.

Referring to FIGS. 9 through 12, three cells consecutive in the vertical direction are formed by an X1 electrode 207-1 and a the Y1 electrode 208-1, an X2 electrode 207-2 and a Y2 electrode 208-2, and an X-3 electrode 207-3 and a Y3 electrode 208-3, respectively.

FIG. 9 shows that the address discharge is not caused in the cell formed by the electrode 208-1 since display data is not supplied thereto and that the address discharge is caused in the cell of the Y2 electrode 208-2. The voltage applied to the X1 electrode 207-1 adjacent to the Y2 electrode 208-2 is the same as the voltage vX (50 V) applied to the X electrode 207 of the selected line 202. Negative charges are drawn to the Y2 electrode 208-2 naturally since this voltage has a positive polarity so that the drawn charges are collected as the wall charge 204. When the wall charge 204 collected on the X1 electrode 207-1 is small in volume, it does not present any problem when the non-discharge slit is as wide as 300 $\mu$m as shown in FIG. 9.

However, as the cell pitch becomes small as shown in FIG. 10 so that the non-discharge slit is as narrow as, for instance, 200 $\mu$m, the wall charges 204 is collected in a large amount on the X1 electrode 207-1 side. When the minimum sustain discharge voltage between the X1 electrode 207-1 and the Y2 electrode 208-2, that is, the minimum sustain discharge voltage in the non-discharge slit, is 190 V, the discharge between address electrode 209 and the Y2 electrode 208-2 may trigger the discharge between the X1 electrode 207-1 and the Y2 electrode 208-2, forming the wall charge 204.

Moreover, as shown in FIG. 11, the discharge with a large scale occurs when the voltage (Va) of the address pulse (voltage Va) to be applied to the address electrode 209 is raised from 50 V to 70 V so as to ensure that the discharge between the address electrode 209 and the Y electrode 208 which discharge is the first step of the address discharge properly occurs. As a result, a lot of the wall charge 204 is collected on the X1 electrode 207-1 side.

Moreover, as shown in FIG. 12, the discharge with a large scale occurs when the voltage (Vx) to be applied to the X electrode 207 is raised from 50 V to 70 V so as to ensure that the discharge between the X electrode 207 and the Y electrode 208 which discharge is the second step of the address discharge properly occurs. As a result, a lot of the wall charge 204 is collected on the X1 electrode 207-1 side.

That is, there is a problem with the conventional technology in that the improper discharge occurs as a result of a large amount of negative charge collected on the X1 electrode 207-1, causing an improper discharge.

Next, an unfavorable example of the sustain discharge (vertical connection) is explained by referring to FIG. 13.

Since the cell of the X1 electrode 207-1 is OFF, the address discharge is not caused before the sustain discharge period is started in FIG. 13. The wall charge 204 collected on the X1 electrode 207-1 may reduce the potential of the X electrode and cause the discharge between X1 and Y1 when the sustain pulse of a voltage Vs (180 V) is applied to the Y electrode 208. Moreover, the potential difference between the X1 electrode 207-1 and the address electrode 209 expands due to the wall charge 204. There is a problem in that the discharge between the X1 electrode 207-1 and the Y1 electrode 208-1 is introduced as a result of a process which corresponds to the first step of the address discharge being caused between the address electrode 209 and the X1 electrode 207-1.

Next, a description will be given, by referring to FIG. 14, of the malfunction occurring when the address discharge is performed in the plasma display panel 2 with the electrode array shown in FIG. 2.

When the address discharge involving the Y1 electrode 208-1 ends, the address discharge involving the Y2 electrode 208-2 is caused. The discharge between the Y2 electrode 208-2 and the Y1 electrode 208-1 is begun before the target discharge between the Y2 electrode 208-2 and the X2 electrode 207-2 due to a triggering action of the discharge between the address electrode 209 and the Y2 electrode 208-2 initiated by the scan pulse 21 of −150 V applied to the Y2 electrode 208-2. At this time, the address cycle ends without the discharge between the Y electrode 208-2 and the X2 electrode 207-2 being started. There was a problem that the sustain discharge is not initiated in the cell comprising the Y1 electrode 208-1 and in the cell comprising the Y2 electrode 208-2.

The present invention can ensure that propagation of the space charge from the cell selected for the address discharge is small in scale by ensuring that a lower potential occurs in the non-selected X electrode than the potential of the selected X electrode This arrangement avoids an unfavorable situation in which a discharge is caused in a line not selected, or an improper discharge is caused due to collection of the wall charge.

SUMMARY OF THE INVENTION

Accordingly, an object of the present invention is to provide a method of operating a plasma display panel capable of performing a stable discharge in a plasma display panel characterized by a small cell pitch and a narrow non-discharge slit.

Another and more specific object of the present invention is to provide a high-brightness, high-resolution plasma display panel with a high cost performance.

In order to achieve the aforementioned objects, the present invention provides a method of operating a plasma display panel provided with first electrode arrays arranged in rows each formed of a pair of first and second electrodes, and second electrode arrays arranged in rows each formed of a third electrode, each of the first and second arrays being sandwiched between substrates so as to form a display line, display cells being formed at the crosspoints of the electrodes of the two arrays, an address discharge process for writing information is caused in a selected cell by applying a pulse to the second electrode and the third electrode forming the selected cell, and said information being displayed such that a sustain discharge is caused by applying, in accordance with the information written as a result of the address discharge process, a sustain pulse to the first and second electrodes forming said display cell, wherein said address discharge process is controlled such that a potential difference provided by a selection potential for the first electrode and occurring across a second gap between the first and second electrodes selected for the sustain discharge is greater than a potential difference provided by a non-selection potential for the first electrode and occurring across a first gap between the second electrode selected for the sustain discharge and the first electrode not selected for the sustain discharge.

The present invention also provides a plasma display device provided with a plasma display panel, first electrode arrays arranged in rows each formed of a pair of first and second electrodes, and second electrode arrays arranged in rows each formed of a third electrode, each of the first and second arrays being sandwiched between substrates so as to form a display line, display cells being formed at the crosspoints of the electrodes of the two arrays, an address discharge process for writing information is caused in a selected cell by applying a pulse to the second electrode and the third electrode forming the selected cell, and said information being displayed such that a sustain discharge is caused by applying, in accordance with the information written as a result of the address discharge process, a sustain pulse to the first and second electrodes forming said display cell, said plasma display device comprising:

first electrode operating means for controlling said address discharge process such that a potential difference provided by a selection potential for the first electrode and occurring across a second gap between the first and second electrodes selected for the sustain discharge is greater than a potential difference provided by a non-selection potential for the first electrode and occurring across a first gap between the second electrode selected for the sustain discharge and the first electrode not selected for the sustain discharge.

The present invention also provides a plasma display panel provided with a plasma display panel, first electrode arrays arranged in rows each formed of a pair of first and second electrodes, and second electrode arrays arranged in rows each formed of a third electrode, each of the first and second arrays being sandwiched between substrates so as to form a display line, display cells being formed at the crosspoints of the electrodes of the two arrays, wherein a first gap between the second electrode selected for the sustain discharge and the first electrode not selected for the sustain discharge is wider than a second gap between the first and second electrodes selected for the sustain discharge, and said first electrode operating means comprises: a first selection driver for operating, in a first half of the address discharge process, the first electrodes for even display lines by supplying the first electrodes with one of the selection potential and the non-selection potential; a second selection driver operating, in a second half of the address discharge process, the first electrodes for odd display lines; and a common driver for supplying a sustain pulse to all the first electrodes in the sustain discharge following the address discharge process.

The present invention also provides a plasma display device provided with a plasma display panel, first electrode arrays arranged in rows each formed of a pair of first and second electrodes, and second electrode arrays arranged in rows each formed of a third electrode, each of the first and second arrays being sandwiched between substrates so as to form a display line, display cells being formed at the crosspoints of the electrodes of the two arrays, wherein a first gap between the second electrode selected for the sustain discharge and the first electrode not selected for the sustain discharge is wider than a second gap between the first and second electrodes selected for the sustain discharge, an address discharge for writing information is caused in a cell selected by applying a pulse to the second electrode and the third electrode forming the selected cell, and said information is displayed such that a sustain discharge is caused by applying, in accordance with the information written as a result of the address discharge process, a sustain pulse to the first and second electrodes forming said display cell, and said first electrode operating means comprises:

a scan driver provided in each of the first electrodes so as to supply the selection potential and the non-selection potential thereto; and a common driver for supplying a sustain pulse to all the first electrodes in the sustain discharge following the address discharge process.

The present invention also provides a method of operating a plasma display panel provided with first electrode arrays arranged in rows each formed of a pair of first and second electrodes, and with second electrode arrays arranged in rows each formed of a third electrode, each of the first and second arrays being sandwiched between substrates so as to form a display line, display cells being formed at the crosspoints of the electrodes of the two arrays, the first and second electrodes having alternately opposite disposition from one display line to another, a first gap between the second electrode selected for the sustain discharge and the first electrode not selected for the sustain discharge being wider than a second gap between the first and second electrodes selected for the sustain discharge, an address discharge process for writing information being caused in a selected cell by applying a pulse to the second electrode and the third electrode forming the selected cell, and said information being displayed such that the sustain discharge is caused by applying, in accordance with the information written as a result of the address discharge process, a sustain pulse to the first and second electrodes forming said display cell, wherein, in a first half of the address discharge process, the address discharge process is sequentially executed in one group of second electrodes for one of even display lines and odd display lines, whereupon the sustain pulse is applied to the electrodes, in an interim between the first half of the address discharge process and a second half thereof, the sustain discharge is caused in the cells in which the address discharge is caused during the first half of the address discharge process, and in a second half of the address discharge process, the address discharge process is sequentially executed in the other group of second electrodes for the other of the even display lines and the odd display lines, and in a last phase, the sustain pulse is alternately applied to all the first and second electrodes so that the sustain discharge is caused.

The present invention also provides a plasma display device provided with first electrode arrays arranged in rows each formed of a pair of first and second electrodes, and with second electrode arrays arranged in rows each formed of a third electrode, each of the first and second arrays being sandwiched between substrates so as to form a display line, display cells being formed at the crosspoints of the electrodes of the two arrays, the first and second electrodes having alternately opposite disposition from one display line to another, a first gap between the second electrode selected for the sustain discharge and the first electrode not selected for the sustain discharge being wider than a second gap between the first and second electrodes selected for the sustain discharge, an address discharge process for writing information being caused in a selected cell by applying a pulse to the second electrode and the third electrode forming the selected cell, and said information being displayed such that the sustain discharge is caused by applying, in accordance with the information written as a result of the address discharge process, a sustain pulse to the first and second electrodes forming said display cell, wherein, said plasma display device comprising:

operating means operating the plasma display panel such that, in a first half of the address discharge process, the address discharge process is sequentially executed in one group of second electrodes for one of even display lines and odd display lines, whereupon the sustain pulse is applied to the electrodes, in an interim between the first half of the address discharge process and a second half thereof, the sustain discharge is caused in the cells in which the address discharge is caused during the first half of the address discharge process, and in a second half of the address discharge process, the address discharge process is sequentially executed in the other group of second electrodes for the other of the even display lines and the odd display lines; and sustain discharge means for alternately applying the sustain pulse to-all the first and second electrodes so that the sustain discharge is caused.

BRIEF DESCRIPTION OF THE DRAWINGS

Other objects and further features of the present invention will be apparent from the following detailed description when read in conjunction with the accompanying drawings, in which.

DESCRIPTION OF THE PREFERRED EMBODIMENTS

A description will be given in the following, with reference to FIGS. 1 through 4, of the AC plasma display panel.

The AC plasma display panel used in the embodiments of the present invention have the same structure as the conventional AC plasma display panel 2 shown in FIG. 1 through 4. However, the plasma display panel of the present invention differs from that of the conventional technology in that the distance of the non-discharge slit is set to 200 $\mu$m.

Two types of AC plasma display panels are known: a dual-electrode plasma display panel in which two electrodes are used to perform an address discharge and a sustain discharge; and a triple-electrode plasma display panel in which three electrodes are used to perform the address discharge. A triple-electrode surface-discharge AC plasma display panel is normally used as a color display panel. A triple-electrode surface-discharge AC plasma display panel may be constructed such that a third electrode is formed on the same substrate on which first and second electrodes selected for the sustain discharge are formed. Alternatively, the triple-electrode surface-discharge AC display panel may be constructed such that a third electrode is formed on a separate substrate facing the substrate on which the first and second electrodes are formed.

The plasma display panel in which the three electrodes are formed on the same substrate may be constructed such that the third electrode is provided above the two electrodes for the sustain discharge. Alternatively, the third electrode is formed below the two electrodes for the sustain discharge. According to another classification, a plasma display panel may be a transparent plasma display panel constructed such that visible light emitted and transmitted by the fluorescent body is observed human eyes. A reflection plasma display panel is constructed such that the reflection from the fluorescent body is observed.

A cell in which a discharge takes place is separated from the adjacent cells by ribs or barriers. Ribs or barriers may be provided to surround on all four sides a cell in which a discharge takes place. Alternatively, a rib or a barrier may be provided to cover one of the four sides of the cell so that, on the remaining three sides, the cell is separated from the adjacent cells by optimizing gaps between electrodes.

A description will now be given of a reflection triple electrode surface-discharge AC plasma display panel in which the third electrode is formed on a substrate facing the substrate on which the electrodes for the sustain discharge are formed, ribs are formed only in an orthogonal direction (that is, in a direction perpendicular to the direction in which the sustain electrodes lie and parallel to the direction in which the third electrode lies), and each of the sustain electrodes is formed in part by a transparent electrode.

Figure 1:
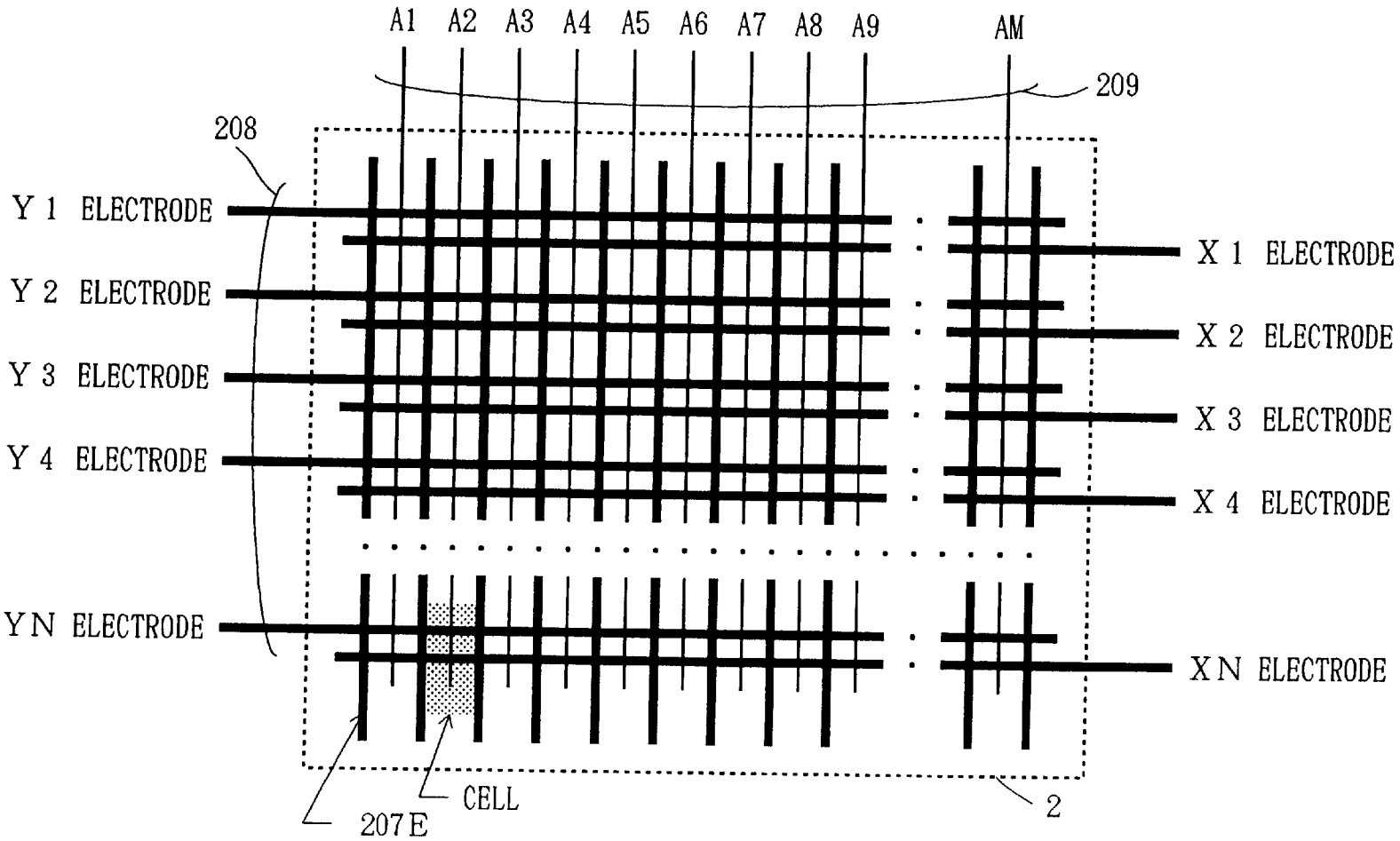
FIG. 1 PRIOR ART
FIG. 1 is a top view showing the construction of a triple-electrode surface-discharge AC plasma display panel having the Y-X-Y-X array electrode structure.
Figure 2:
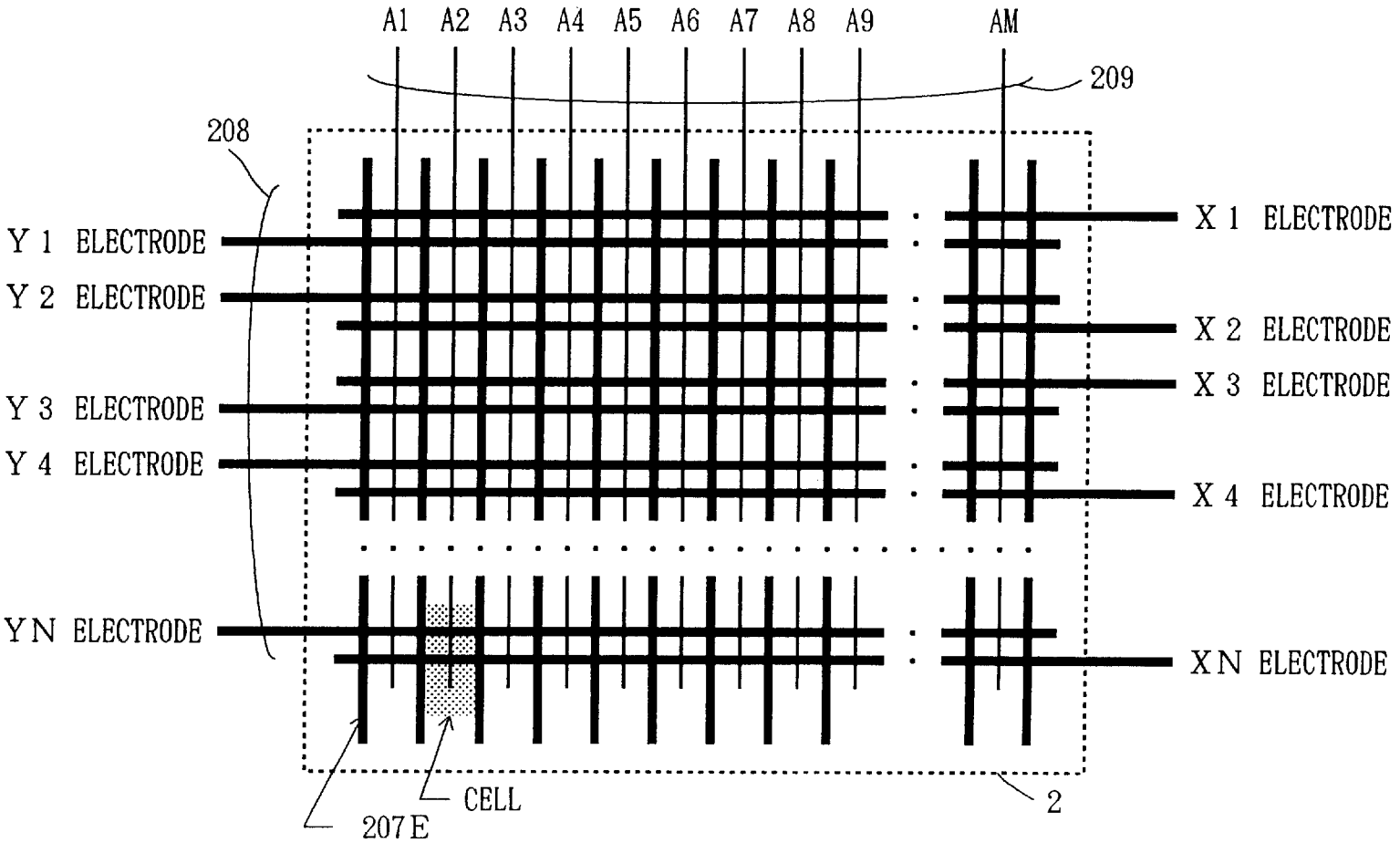
FIG. 2 PRIOR ART
FIG. 2 is a top view showing the construction of a triple-electrode surface-discharge AC plasma display panel having the Y-X-X-Y array electrode structure wherein connections between the electrodes are improved so as to reduce the capacitance between the electrodes.

FIG. 1 shows such a reflection triple-electrode surface-discharge AC plasma display panel 2. FIG. 2 shows another triple-electrode surface-discharge AC plasma display panel 2 which is an elaboration of the panel of FIG. 2 in that the disposition of the electrodes is improved so that the capacitance between electrodes is reduced.

The triple -electrode surface-discharge AC plasma display panel 2 shown in FIG. 1 in which the first electrode 207 (X electrode) and the second electrode (Y electrode) are alternately arranged will be referred to as a Y-X-Y-X array triple-electrode surface-discharge AC plasma display panel. The triple-electrode surface-discharge AC plasma display panel 2 shown in FIG. 1 in which one of the first electrode 207 (X electrode) and two of the second electrodes 208 (Y electrode) are alternately arranged will be referred to as a Y-X-X-Y array triple-electrode surface-discharge AC plasma display panel.

Figure 3:
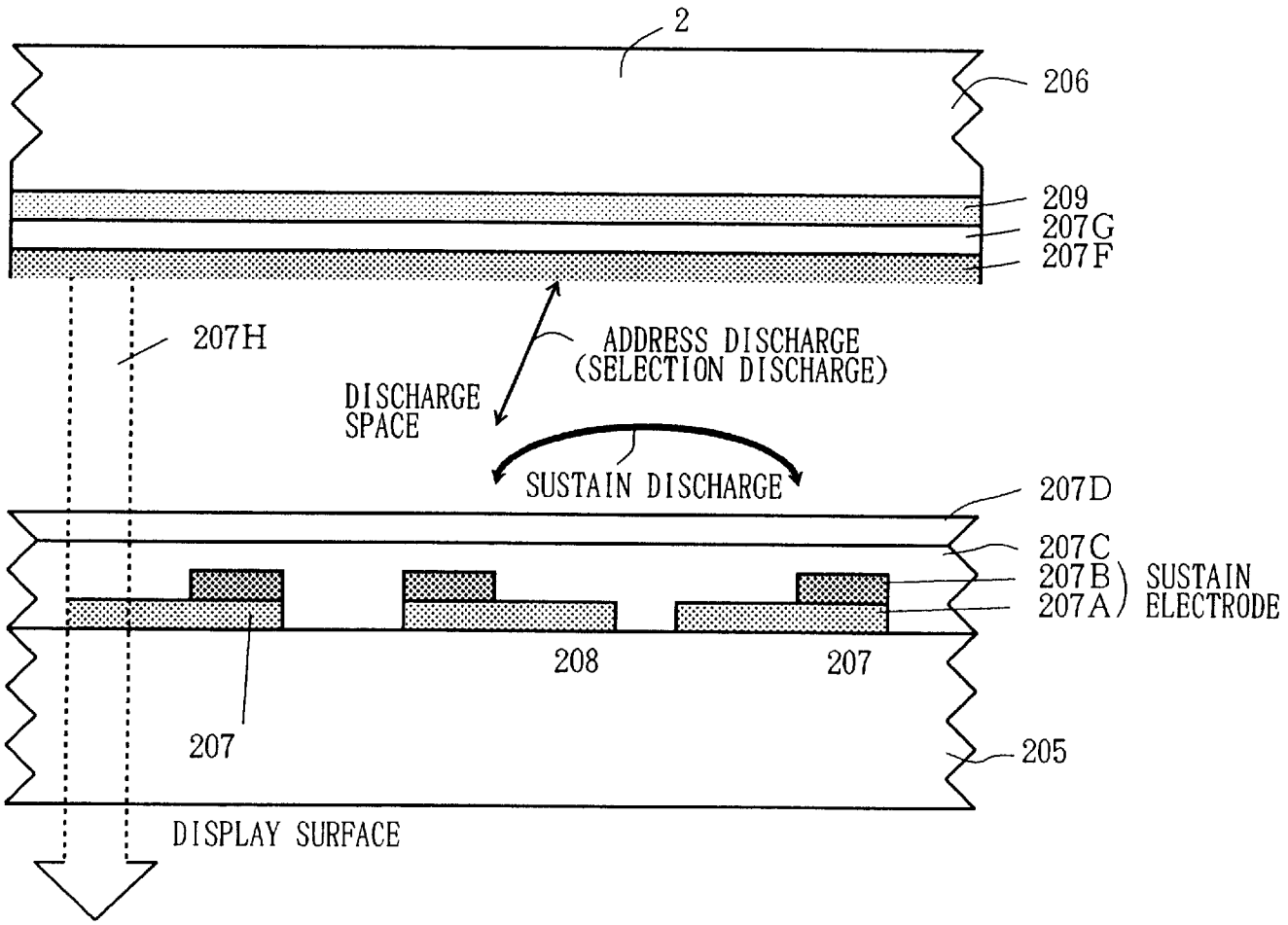
FIG. 3 PRIOR ART
FIG. 3 is a sectional view, taken along the address electrode, of the plasma display panel shown in FIG. 1 having the Y-X-Y-X array electrode structure and the plasma display panel shown in FIG. 2 having the Y-X-X-Y array electrode structure.
Figure 4:
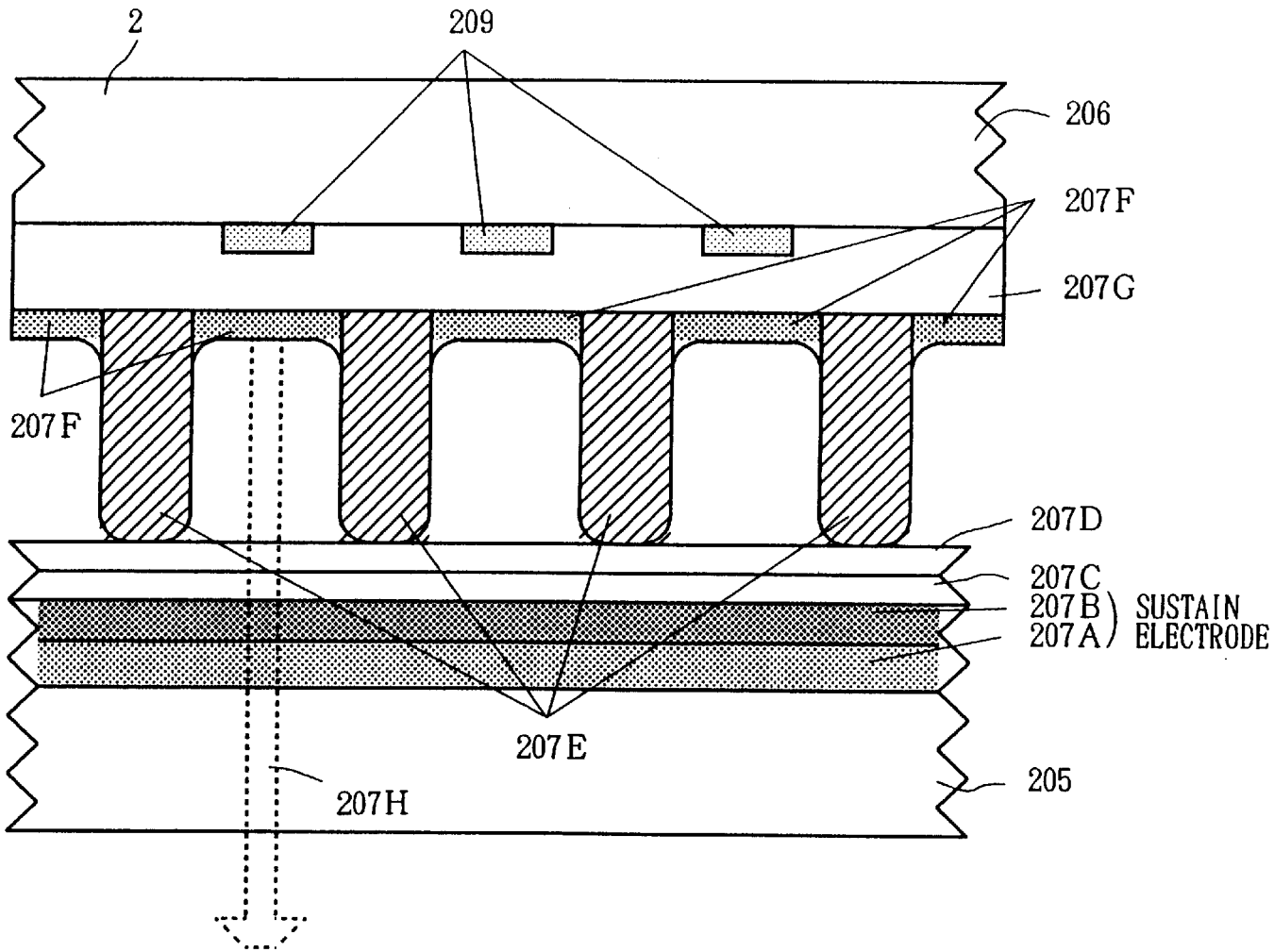
FIG. 4 PRIOR ART
FIG. 4 is a sectional view, taken along the sustain electrode, of the plasma display panel shown in FIG. 1 having the Y-X-Y-X array electrode structure and the plasma display panel shown in FIG. 2 having the Y-X-X-Y array electrode structure.

FIG. 3 is a sectional view of the triple-electrode surface-discharge AC plasma display panel having the Y-X-Y-X array or the Y-X-X-Y array taken along the direction in which the third electrodes 209 lie. FIG. 4 is a sectional view of the plasma display panel having the Y-X-Y-X array or the Y-X-X-Y array taken along the direction in which the sustain electrodes lie.

As shown in FIGS. 3 and 4, the triple-electrode surface-discharge AC plasma display panel having the Y-X-Y-X array or the Y-X-X-Y array includes a rear glass substrate 206 and a front glass substrate 205. A first electrode 207 (specifically, X electrode) and a second electrode 208 (specifically, Y electrode) are formed in the front glass substrate 205 with a separation of a discharge slit (that is, a gap between the X electrode 207 and the Y electrode 208 set to about 100 μm). A pair formed by the first electrode 207 and the second electrode 208 constitutes a sustain electrode. Each of these electrodes 207, 208 is composed by a transparent electrode 207A and a bus electrode 207B. The transparent electrode 207A lets a reflected beam 207H from a fluorescent body 207 to pass therethrough. The bus electrode 207B is provided to prevent a voltage drop by an electrode resistance. In addition, the electrodes are coated by a dielectric layer 207C and a MgO (magnesium oxide) film 207D is formed on the discharge side as a protective film. Moreover, a third electrode (address electrode) 209 is formed in the second substrate 206 (specifically, the rear glass substrate 206) opposite to front glass substrate 205 so as to be orthogonal to the first electrode 207. Moreover, a barrier 207E is formed between the address electrodes 209 protected with a dielectric 207G. A fluorescent body 207F with a red, green, blue luminescence characteristic is formed so as to cover the address electrode 209 between the barriers 207E. The rear glass substrate 206 and the front glass substrate 205 are assembled such that a ridge of the barrier 207E and the MgO film 207D are in close contact with each other. Moreover, when the discharge slit between the first electrode 207 and the second electrode 208 which form the pair is set to 100 μm, the non-discharge slit which is a gap between two adjacent sustain electrodes in the respective display lines is set to 200 μm. The width of the sustain electrode is set to about 250 μm.

Next, various embodiments of the present invention will be explained based on the drawings. The first embodiment will now be explained. The method of operation in the first embodiment is a method of operating the triple-electrode plane-discharge AC plasma display panel 2 which has the Y-X-Y-X array electrode structure. It is a method of operation by which the potential of the non-selected X electrode 207 occurring on non-discharge slit side is made lower than the potential of the selected X electrode 207 during the address discharge period according to the separated address period/sustain discharge period write addressing.

The plasma display panel 2 using the method of operation according to the first embodiment has a Y-X-Y-X array electrode structure shown in FIG. 1. The discharge slit is set to 100 μm and the non-discharge slit is set to 200 μm.

Figure 15:
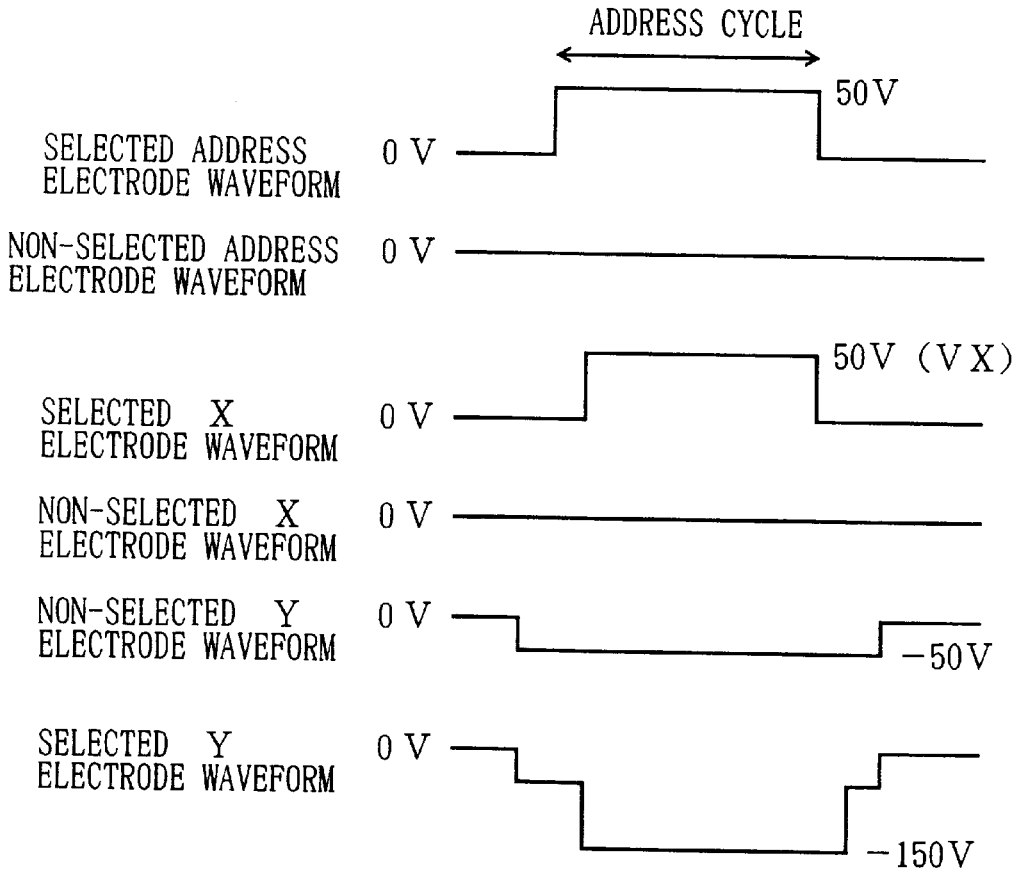
FIG. 15 is a waveform chart in the method of a first embodiment for operating the triple-electrode surface-discharge AC plasma display panel having the Y-X-Y-X array electrode structure.

FIG. 15 is a waveform chart of the method of operation according to the first embodiment. The method of the first embodiment is such that the voltage of the selected X electrode 207 is made different from that of the non-selected X electrode 207. Alternatively, the voltage of the selected x electrode 207 is made different from that of the X electrode 207 opposite to the selected X electrode 207 across the non-discharge slit.

Specifically, the voltage VX (50 V in FIG. 15) is applied to the selected X electrode 207 for as long as an address cycle (specifically, 3 ms), which is an addressing time for each display line. A voltage (specifically, 0 V–100 V) lower than the voltage VX (50 V) is applied to the X electrode 207 not selected. Moreover, −150 V is applied to the selected Y electrode 208 and −50 V is applied to the Y electrode 208 not selected. An optimum value of the voltage (0 V–100 V) applied to the X electrode 207 not selected is determined according to the structure of the cell (electrode). The voltage applied to the X electrode 207 not selected is set to an optimum level by which the space charge is not drawn from the adjacent line or set to an optimum level less than the minimum sustain discharge voltage on the non-discharge slit side.

When the triple-electrode plane-discharge AC plasma display panel 2 which has the Y-X-Y-X array electrode structure of the above-mentioned is operated with the address cycle of 3 ms shown in FIG. 15, the discharge-initiating voltage Vf between the X electrode 207 and the Y electrode 208 has a level beyond 200 V. As a result, the discharge-initiating voltage Vf of all cells in the plasma display panel 2 reaches a level between 230 V–250 V. Specifically, the discharge-initiating voltage of the XI electrode 207 is Vf1=230 V and the discharge-initiating initiating voltage of the Xn electrode 207 is Vfn=250 V. The minimum sustain discharge voltage between X electrode 207 and Y electrode 208 is specifically 150 V.

When the minimum sustain discharge voltage Vsm is set to 150 V, the sustain discharge voltage Vs is set such that 150 V≦ sustain discharge voltage <230 V. According to the first embodiment, the sustain discharge voltage Vs is set to 180 V.

Figure 16:
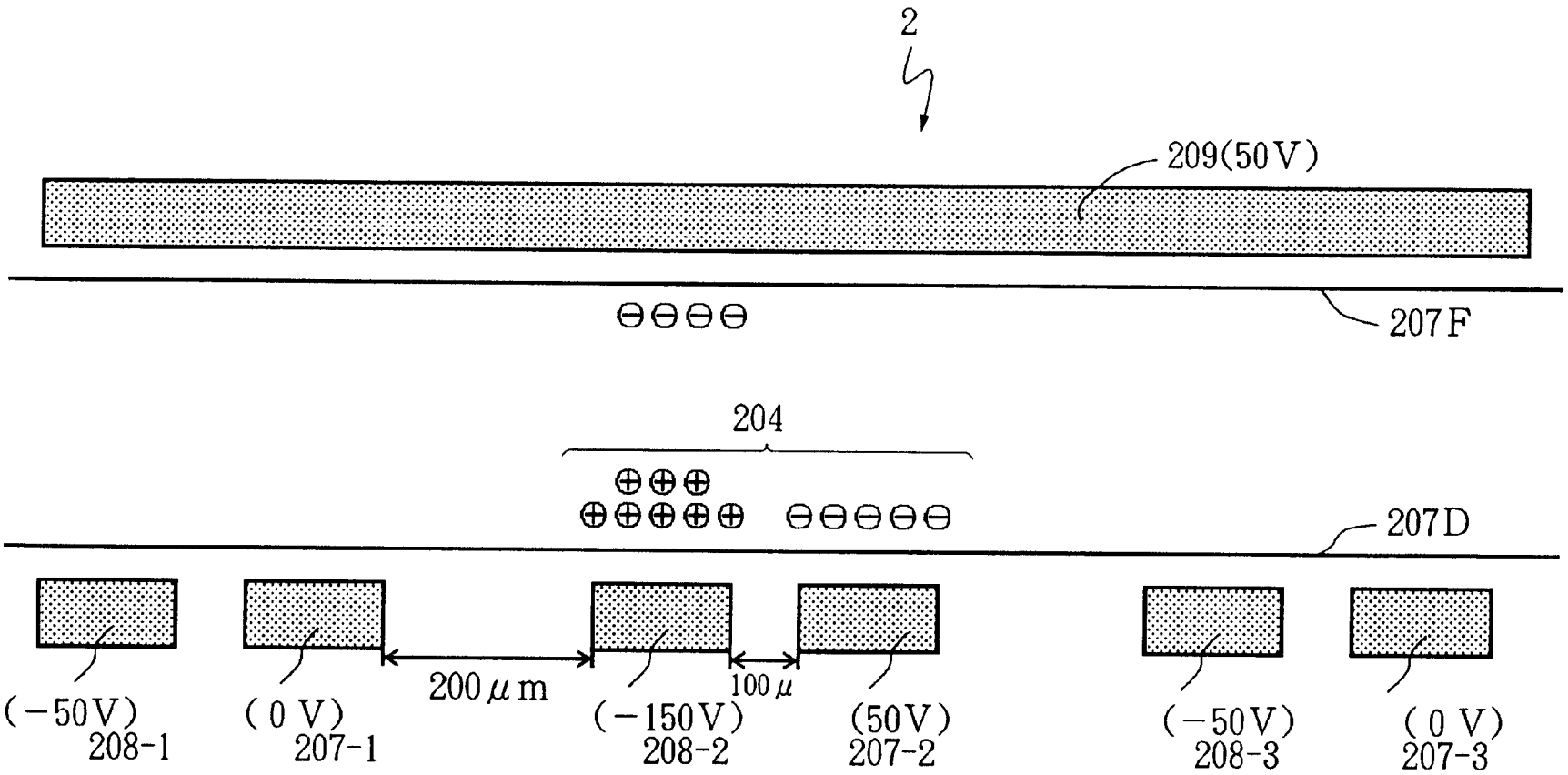
FIG. 16 is a diagram which explains the mechanism of the address discharge in the method of operation according to the first embodiment.

A further description will be given of the method of operating the plasma display panel. FIG. 16 explains the mechanism of the address discharge in the method of operation in the first embodiment.

As shown in FIG. 16, the potential difference between the X electrode 207 and the Y electrode 208 in the addressing is set within the range of the sustain discharge voltage Vs according to the method of operation in the first embodiment. However, in order ensure that the second step of the address discharge is performed more properly, a sum of the sustain discharge voltage Vs and the voltage applied to the Y electrode 208 is equal to VY=200 V. As a result, when the voltage VY applied to the Y electrode 208 selected is set to 150 V, the voltage VX of the X electrode 207 is 50 V. The minimum sustain discharge voltage Vsm in the non-discharge slit becomes 190 V for instance. The discharge in the non-discharge slit is generated if an effect of the priming is available when the potential of all the X electrodes 207 is set to 50 V at addressing. In addition, since the discharge-initiating voltage VfAY1 between the address electrode 209 and the YI electrode 208 is 170 V and the discharge-initiating voltage VfAYn between the address electrode 209 and the Yn electrode 208 is 190 V, a sum of the voltage VY applied to the selected Y electrode 208 and the voltage Va of the address pulse to be applied to the address electrode 209 must exceed 190 V above. Thus, it is preferable to set the voltage Va of the address pulse applied to the address electrode 209 to 50 V when the voltage VY applied to the selected Y electrode 208 is 150 V.

As has been described, the method of operating a plasma display according to the first embodiment is such that the potential of the X electrode 207 of the non-selected line adjacent to the selected Y electrode 208 is set to 0 V (50 V, in the conventional method of operation) during the address discharge for writing of display data. It is possible to set the potential difference between the selected Y electrode 208 and the X electrode 207 not selected to 150 V, which is lower than the minimum sustain discharge voltage Vsm (=190 V) of the non-discharge slit. As a result, even if the plasma display panel 2 has an inter-electrode gap similar to that of the conventional plasma display panel, no collection of the negative charge occurs on the X electrode 207. It is possible to execute a normal address discharge for this non-selected line when it is due in the next address cycle, for example. Further, even when the sustain pulse is applied to the non-selected line, no erroneous discharge is caused. In addition, since the non-discharge slit can be narrowed, high-brightness high-resolution plasma display device can be manufactured.

Figure 17:
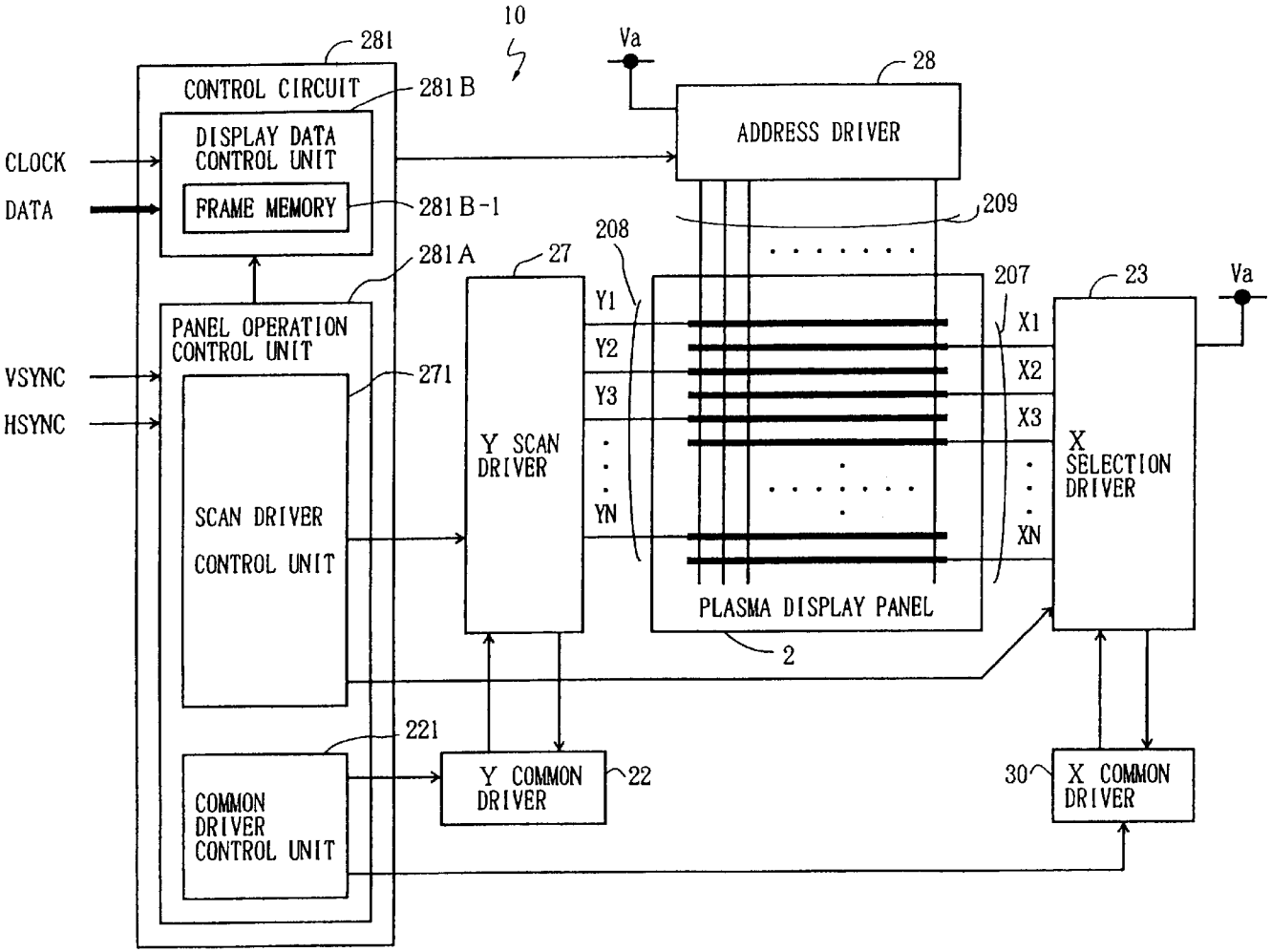
FIG. 17 is a block diagram of a circuit for operating a plasma display device according to a second embodiment in which the triple-electrode surface-discharge AC plasma display panel having the Y-X-Y-X array electrode structure is used.

Next, the second embodiment is explained based on the drawings. FIG. 17 is a block diagram of an operation circuit for operating a plasma display device 10 according to the second embodiment which uses the triple-electrode plane-discharge AC plasma display panel 10 having the Y-X-Y-X array electrode structure. Those elements that are the same as the elements described in the first embodiment are designated by the same reference numerals, and the description thereof is omitted.

Figure 5:
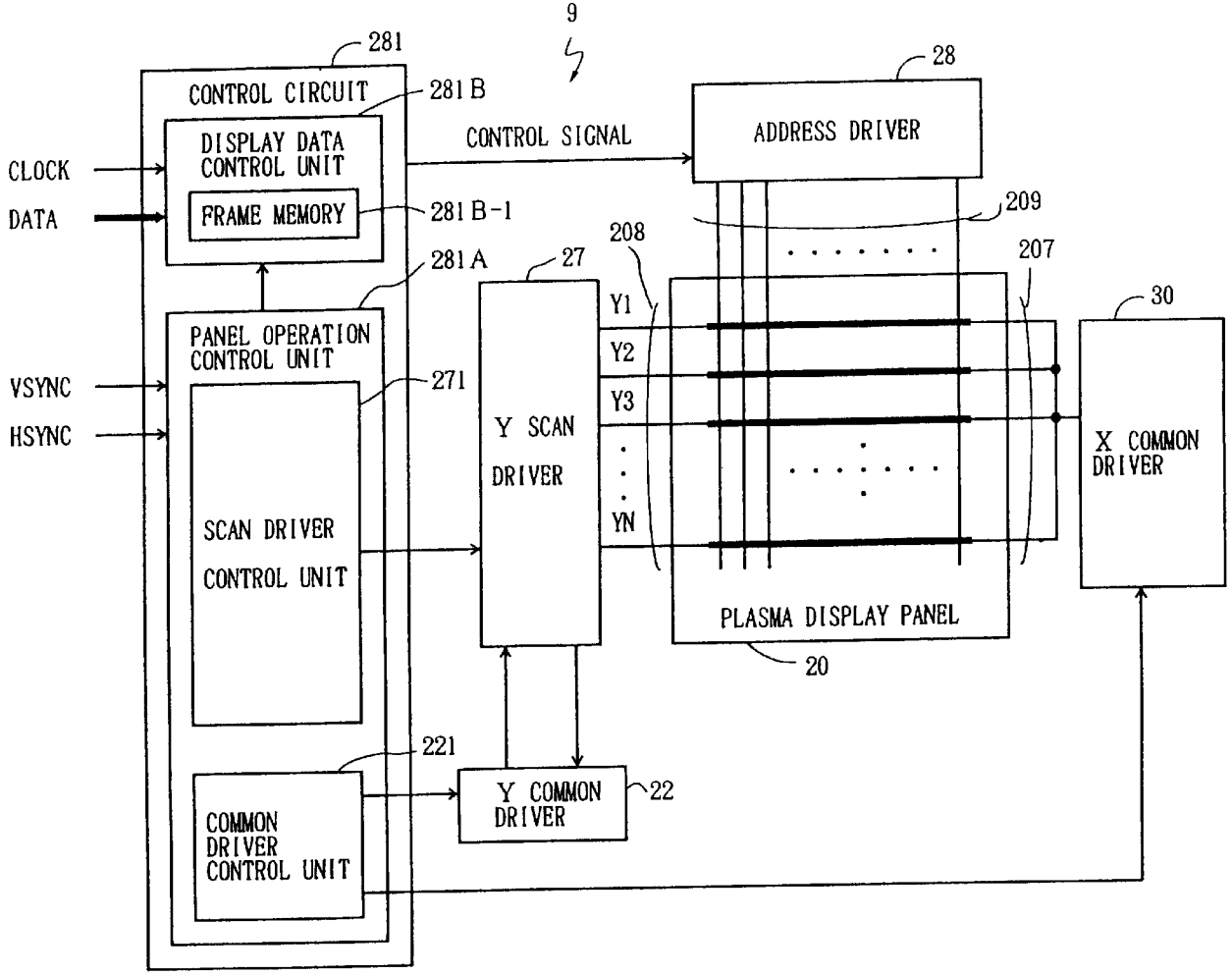
FIG. 5 PRIOR ART
FIG. 5 is a block diagram of a plasma display device provided with a peripheral circuit for operating the plasma display panel shown in FIG. 1 having the Y-X-Y-X array electrode structure and the plasma display panel shown in FIG. 2 having the Y-X-X-Y array electrode structure.
Figure 6:
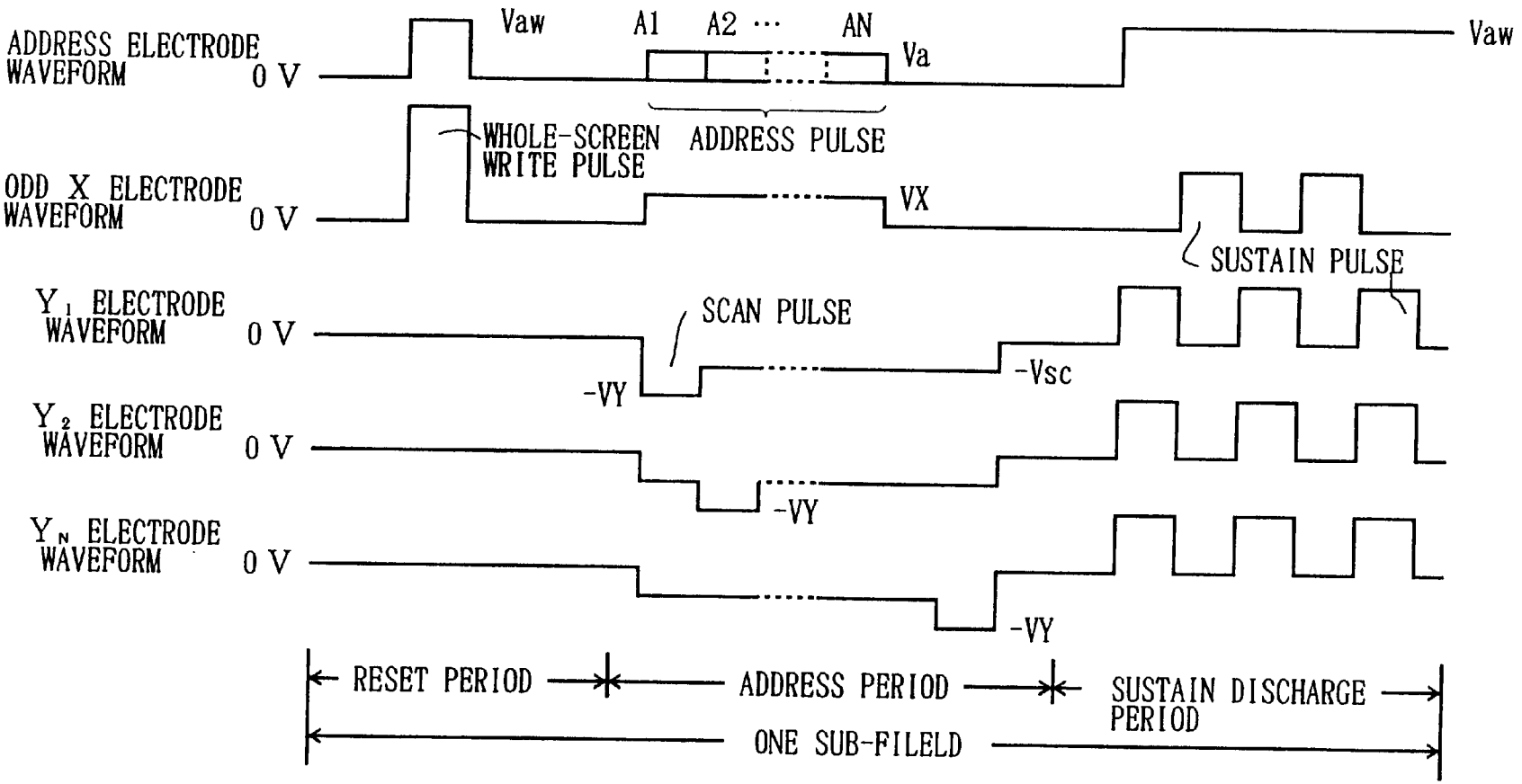
FIG. 6 PRIOR ART
FIG. 6 is a waveform chart which explains a conventional method of operating the plasma display panel shown in FIGS. 1–4 using the circuit shown in FIG. 5, in which method the separated address period/sustain discharge period write addressing is executed and the whole-screen self-erase discharge is carried out in the reset period.
Figure 7A:
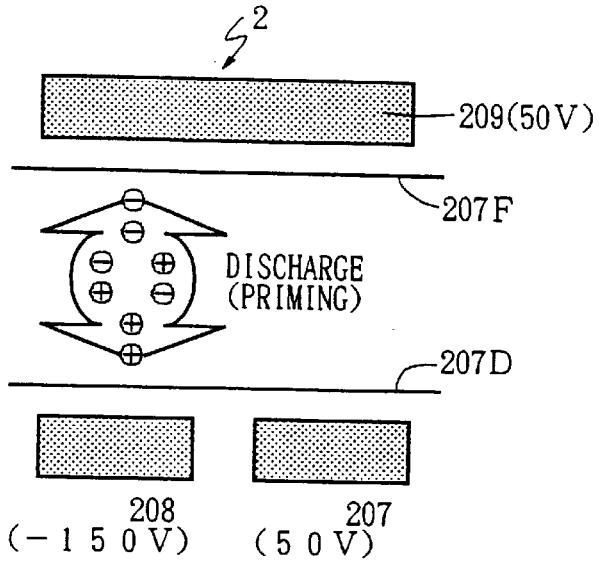
FIG. 7A PRIOR ART
FIGS. 7A–7C are diagrams which explain the mechanism of the address discharge.
Figure 7B:
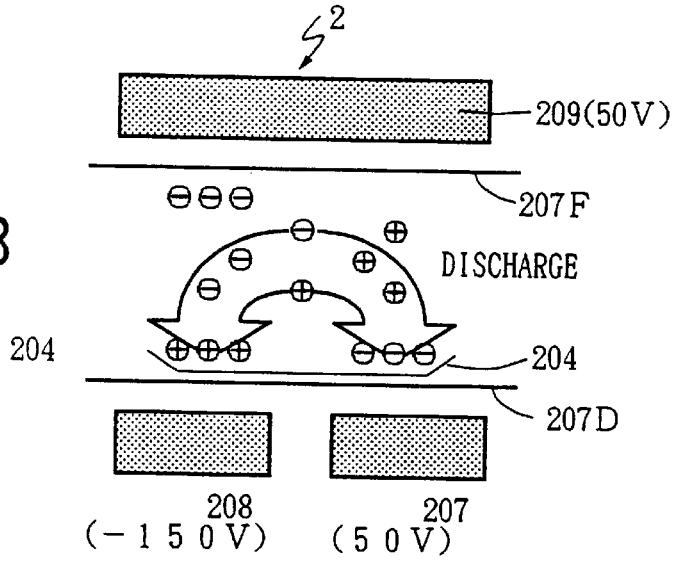
FIG. 7B PRIOR ART
Figure 7C:
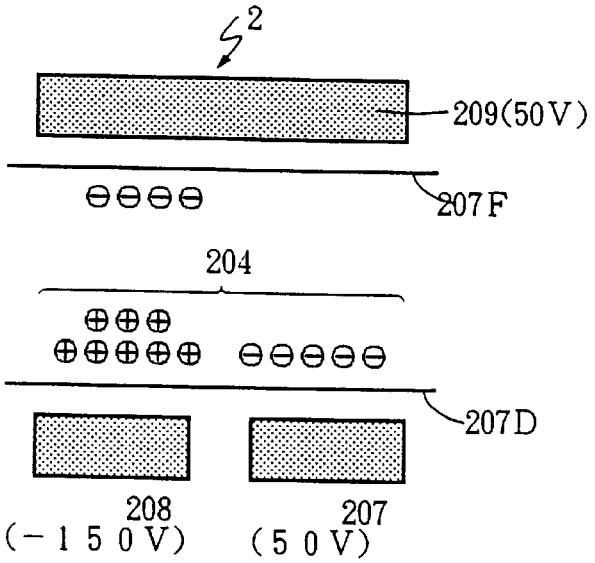
FIG. 7C PRIOR ART
Figure 8:
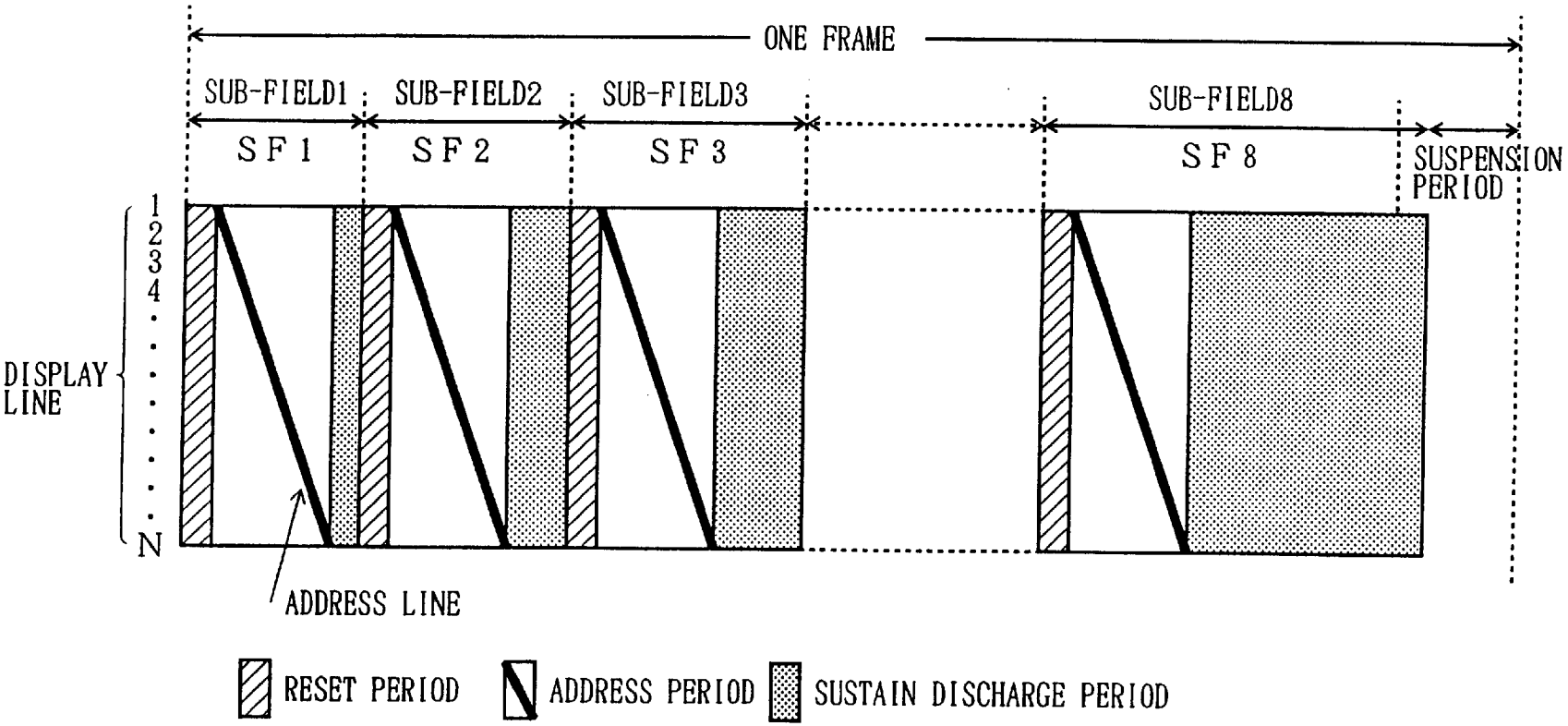
FIG. 8 PRIOR ART
FIG. 8 is a time chart showing the sequence of the separated address period/sustain discharge period write addressing.
Figure 9:
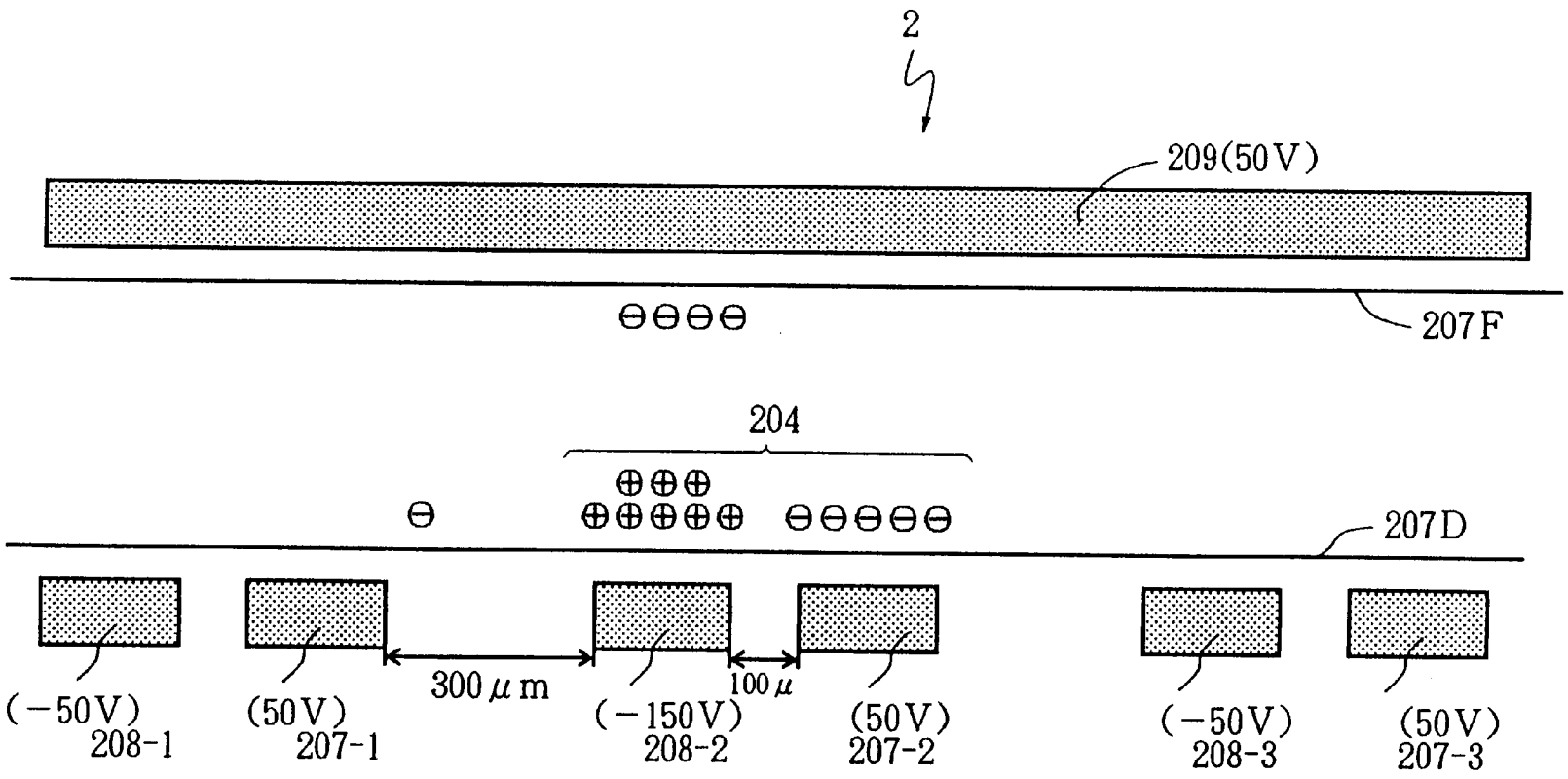
FIG. 9 PRIOR ART
FIG. 9 is a diagram which explains how adjacent cells are affected in the address discharge.
Figure 10:
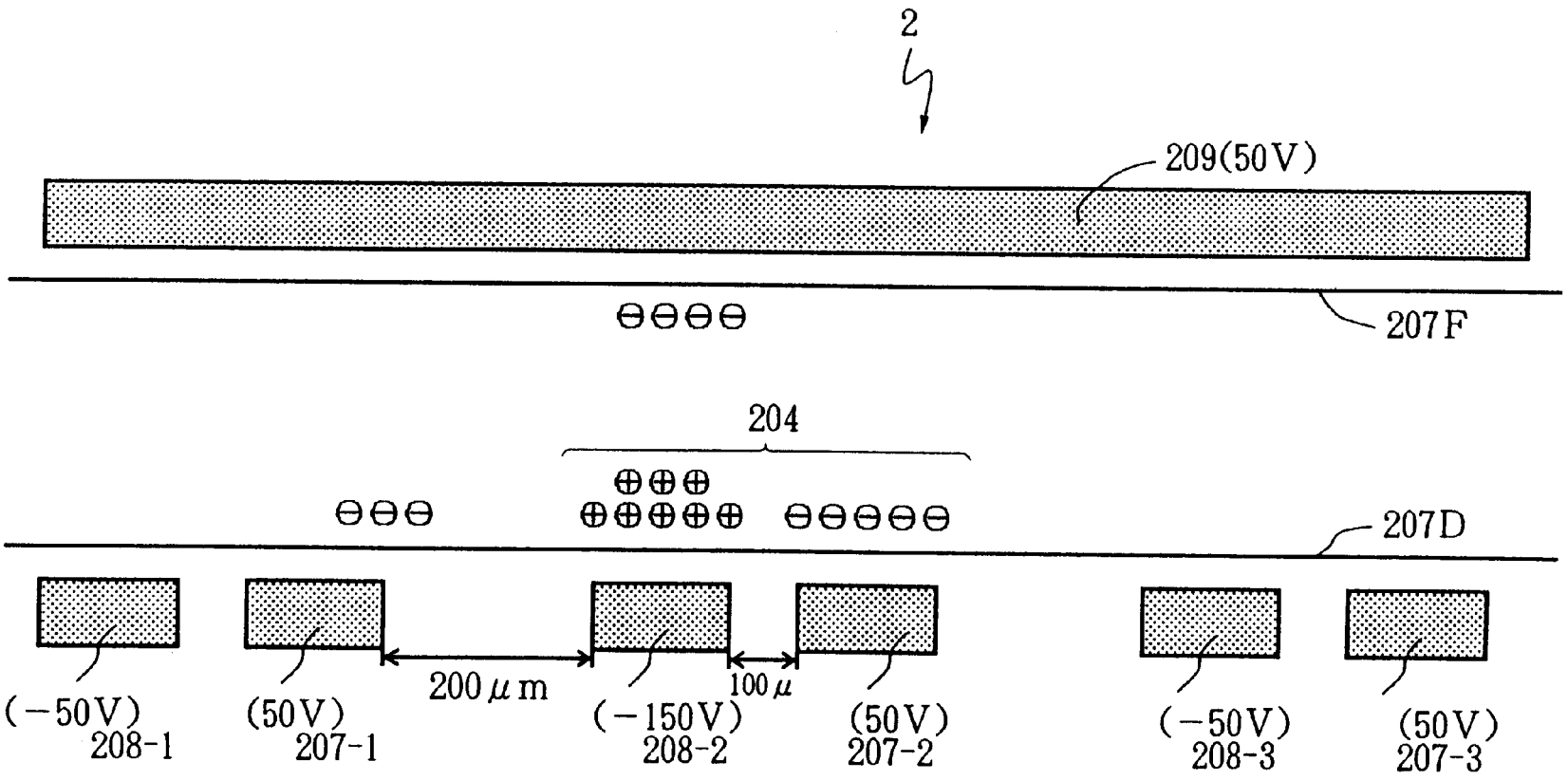
FIG. 10 PRIOR ART
FIG. 10 is a diagram which explains how adjacent cells are affected in the address discharge.
Figure 11:
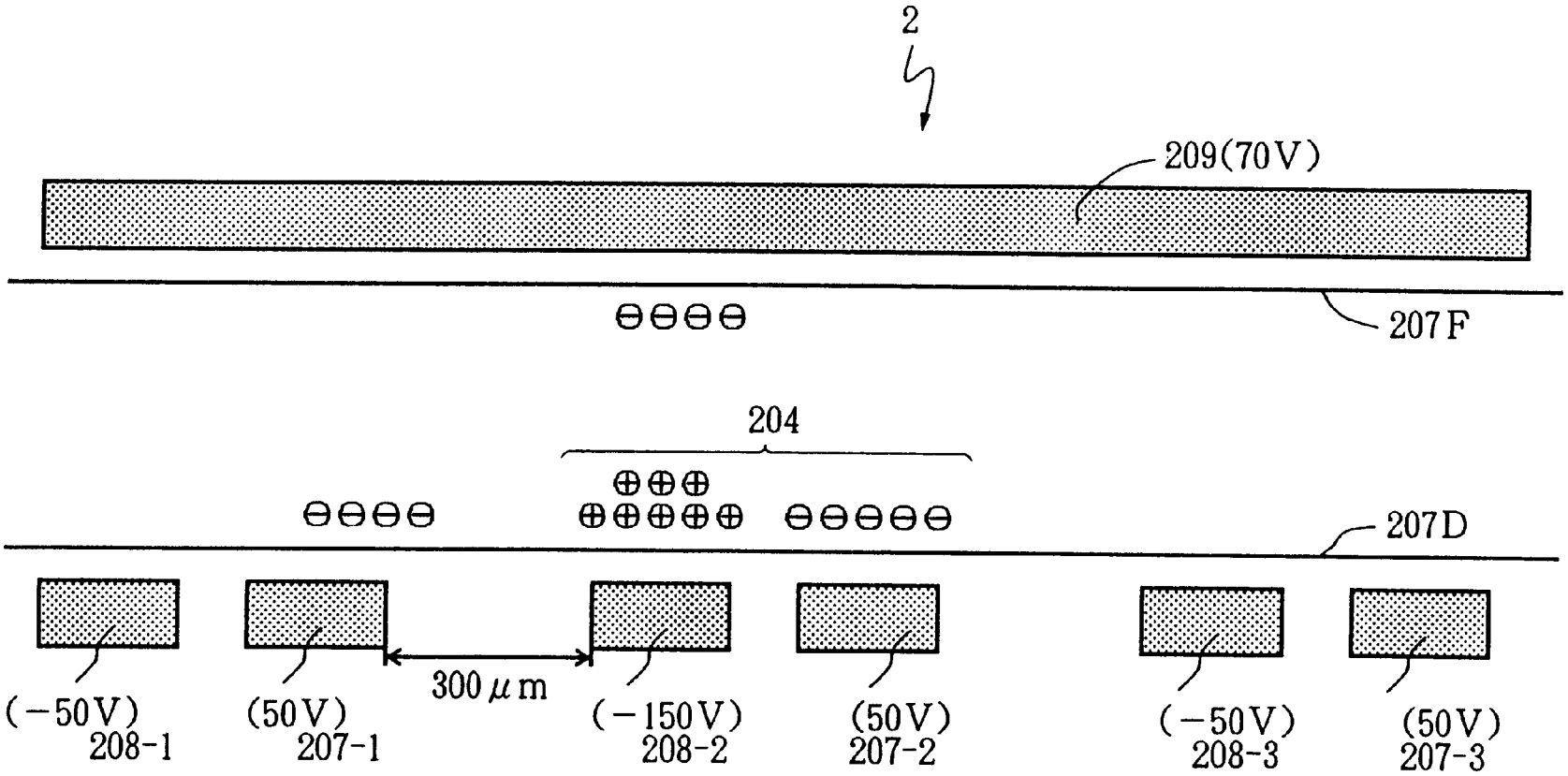
FIG. 11 PRIOR ART
FIG. 11 is a diagram which explains how adjacent cells are affected in the address discharge.
Figure 12:
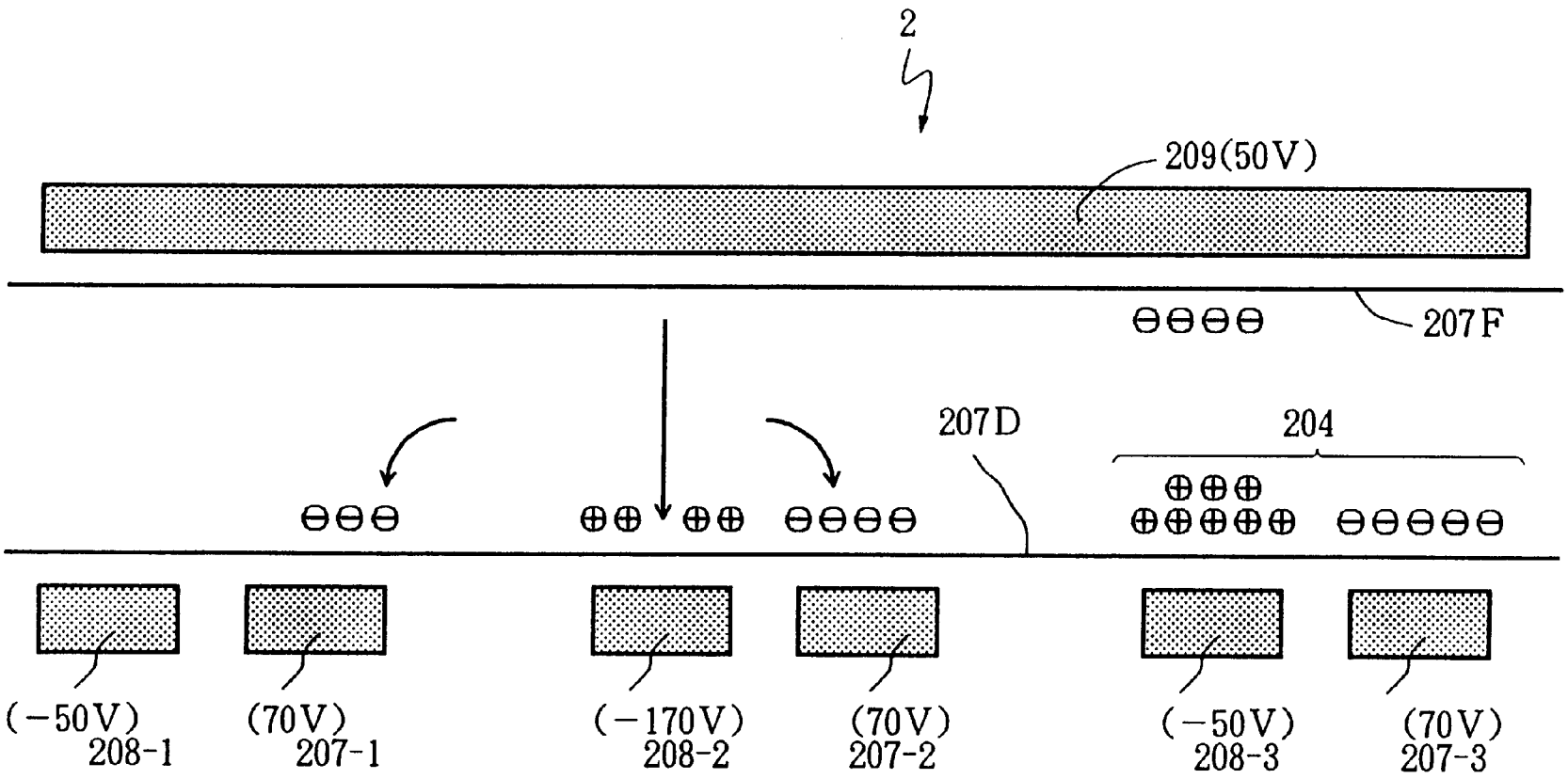
FIG. 12 PRIOR ART
FIG. 12 is a diagram which explains how adjacent cells are affected in the address discharge.
Figure 13:
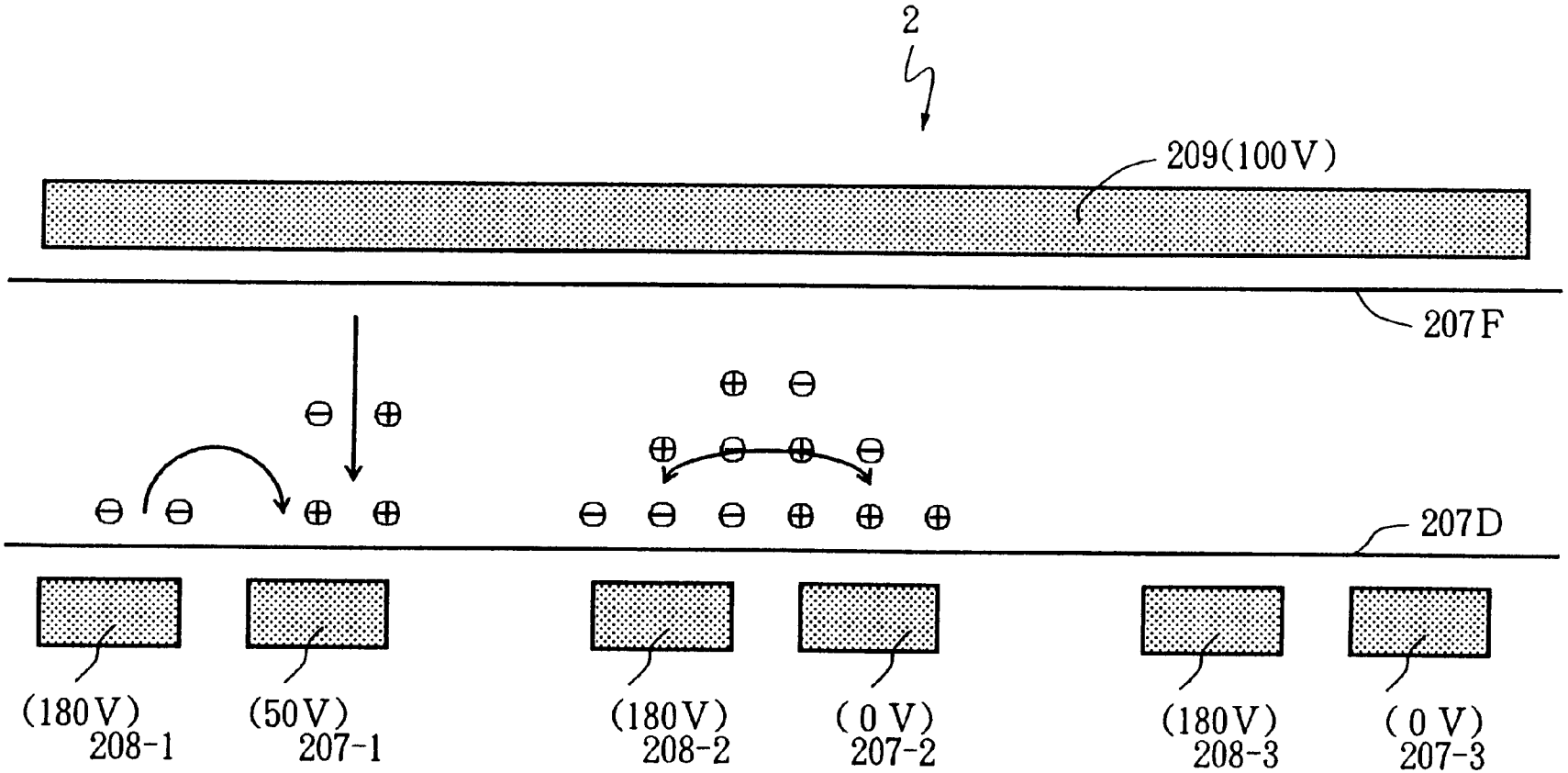
FIG. 13 PRIOR ART
FIG. 13 is a diagram which explains an unfavorable example (vertical connection) of the sustain discharge.
Figure 14:
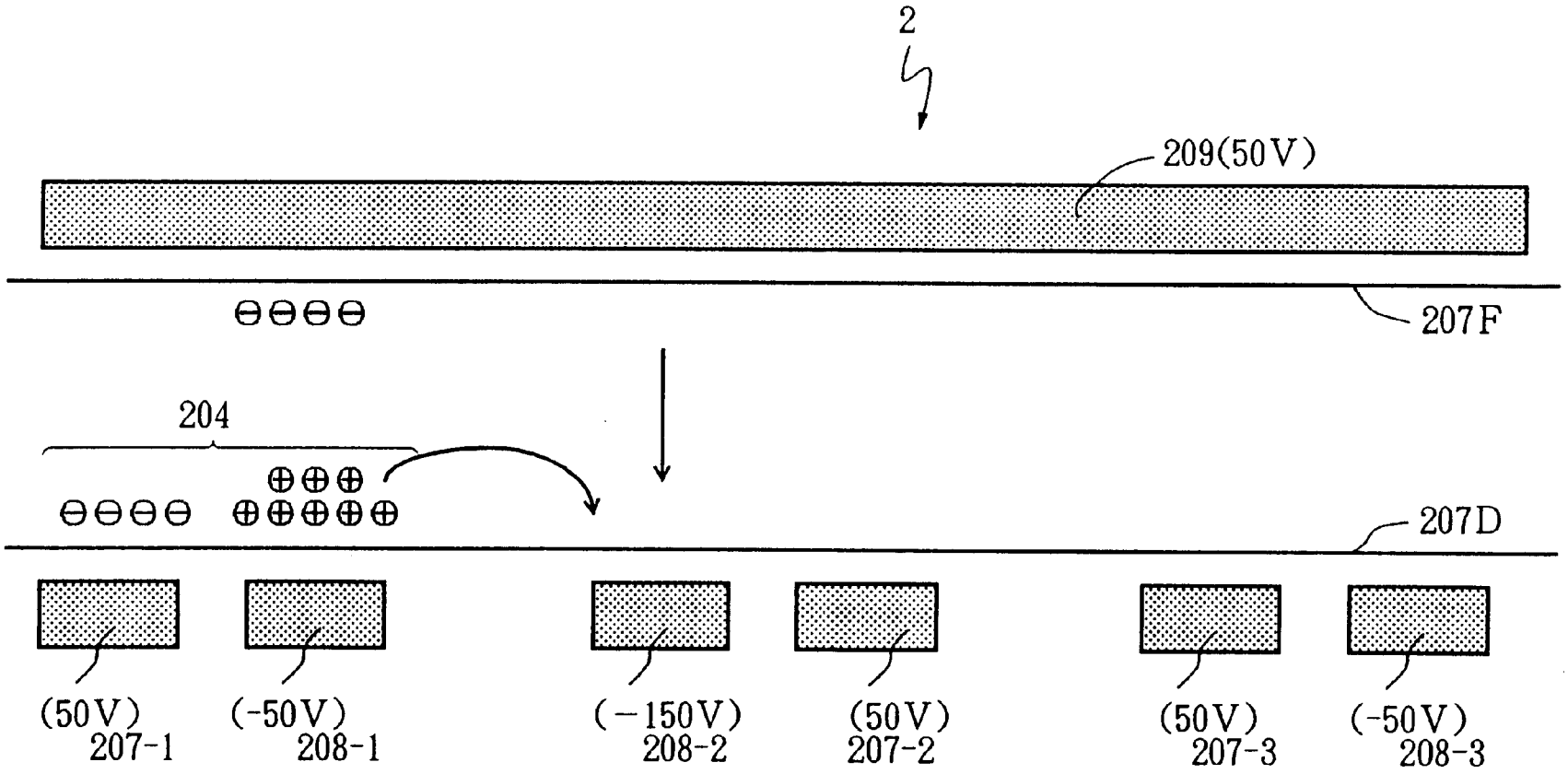
FIG. 14 PRIOR ART
FIG. 14 is a diagram which explains an unfavorable example (vertical connection) of the sustain discharge.

An address pulse for the address discharge is applied to the address electrode 209 using an address driver 28 connected to each of address electrode 209 in the plasma display device 10. The address driver 28 is controlled by a control circuit 281. Moreover, the Y electrode 208 is individually connected to a scan driver 27 (Y scan driver 27). The X electrode 207 is connected together over all display lines 201 of a plasma display panel 2. The X electrode 207 is connected to an X selection driver 23 (a first selection driver). A X-side common driver 22 (sustain pulse applying means) generates the write pulse, and the sustain pulse, etc. and is controlled by a common driver control unit 221. The common driver control unit 221, the scan driver control unit 271, and the control circuit 281 are controlled with a vertical sync signal (VSYNC in FIG. 17) and a horizontal sync signal (HSYNC in FIG. 17) input from outside the device to the panel operation control unit 281A, and with a display data signal (DATA in FIG. 17) and a dot clock (CLOCK in FIG. 17) input to a display data control unit 281B. The display data signal DATA input according to the dot clock CLOCK is stored in a frame memory 281B-1. The Y scan driver 27 (second electrode operation means) is connected to the Y-side common driver 22 and the pulse for the address discharge is generated by the scan driver 27. The sustain pulse etc. are generated by the Y-side common driver 22 (sustain pulse applying means) and these pulses are applied to the Y electrode 208 via the Y scan driver 27 (second electrode operation means). The Y-side common driver 22 is controlled by the common driver control unit 221 provided in the panel operation control unit 281A. The Y scan driver 27 and the X selection driver 23 are controlled by the scan driver control unit 271 installed in the panel operation control unit 281A. Those elements that are the same as the elements described with reference to FIG. 5 are designated by the same reference numerals and the description thereof is omitted.

Figure 18:
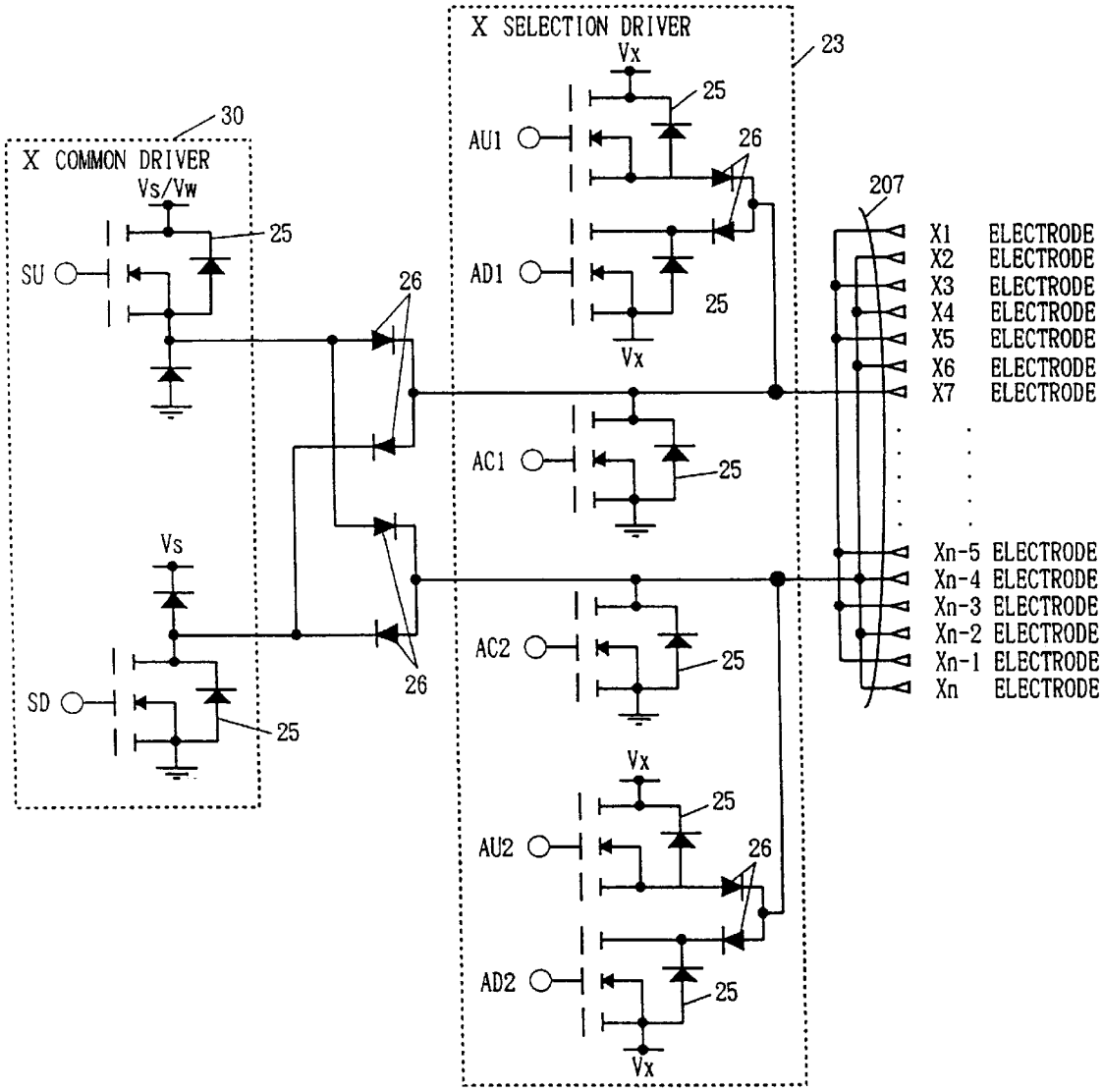
FIG. 18 is a block diagram showing a circuit for operating the X electrode in the plasma display device of FIG. 17.

FIG. 18 is a block diagram which shows X selection driver 23 (first electrode operation means) which is the operation circuit of the X electrode 207 in the plasma display device 10 of FIG. 17. The X common driver 30 (sustain pulse applying means) is connected to the X selection driver 23 (sustain pulse applying means) so as to generate the sustain pulse (sustain discharge voltage Vs) etc. applied to all the X electrodes 207. The X selection driver 23 (first electrode operation means) is composed of the circuit to give a voltage to an odd X electrode group and an even X electrode group independently during the address period. As shown in FIG. 18, each of the X selection driver 23 and the X common driver 30 is composed respectively of FETs (field-effect transistors), which are switching elements 25, and of diodes 26. Moreover, the X common driver 30 and the X selection driver 23 are mutually connected through the diodes 26.

Figure 19:
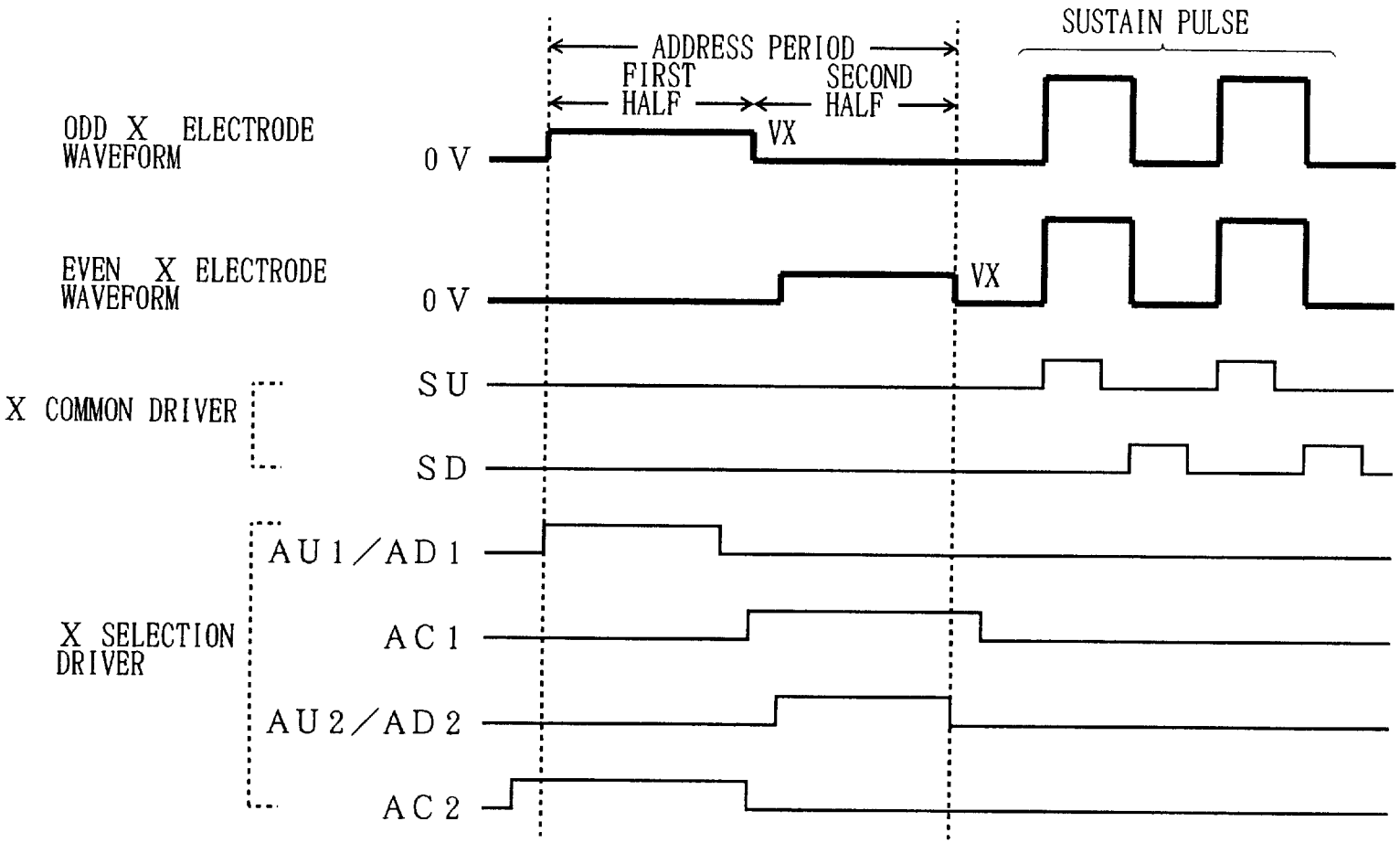
FIG. 19 is a timing chart showing the operation of the circuit for operating the X electrode in the plasma display device of FIG. 17.

A power supply 29 (power supply voltage Vx) of the X selection driver 23 is the same as the power supply 29 (power supply voltage Va) of the address driver. FIG. 19 is a timing chart which shows the operation of the X selection driver 23 of the X electrode 207 in the plasma display device 10 of FIG. 17.

During the address period, the selection potential Vx (50 V) is applied to the odd electrode group by AUI and ADI which are FET25. At this time, the even number line is fixed to 0 V and maintained at the non-selection potential by turning on AC2. On the other hand, when the even number line is addressed, 50 V is given to the even X electrode group by AU2 and AD2. At this time, the odd electrode group is fixed to 0 V by AC1.

Figure 20:
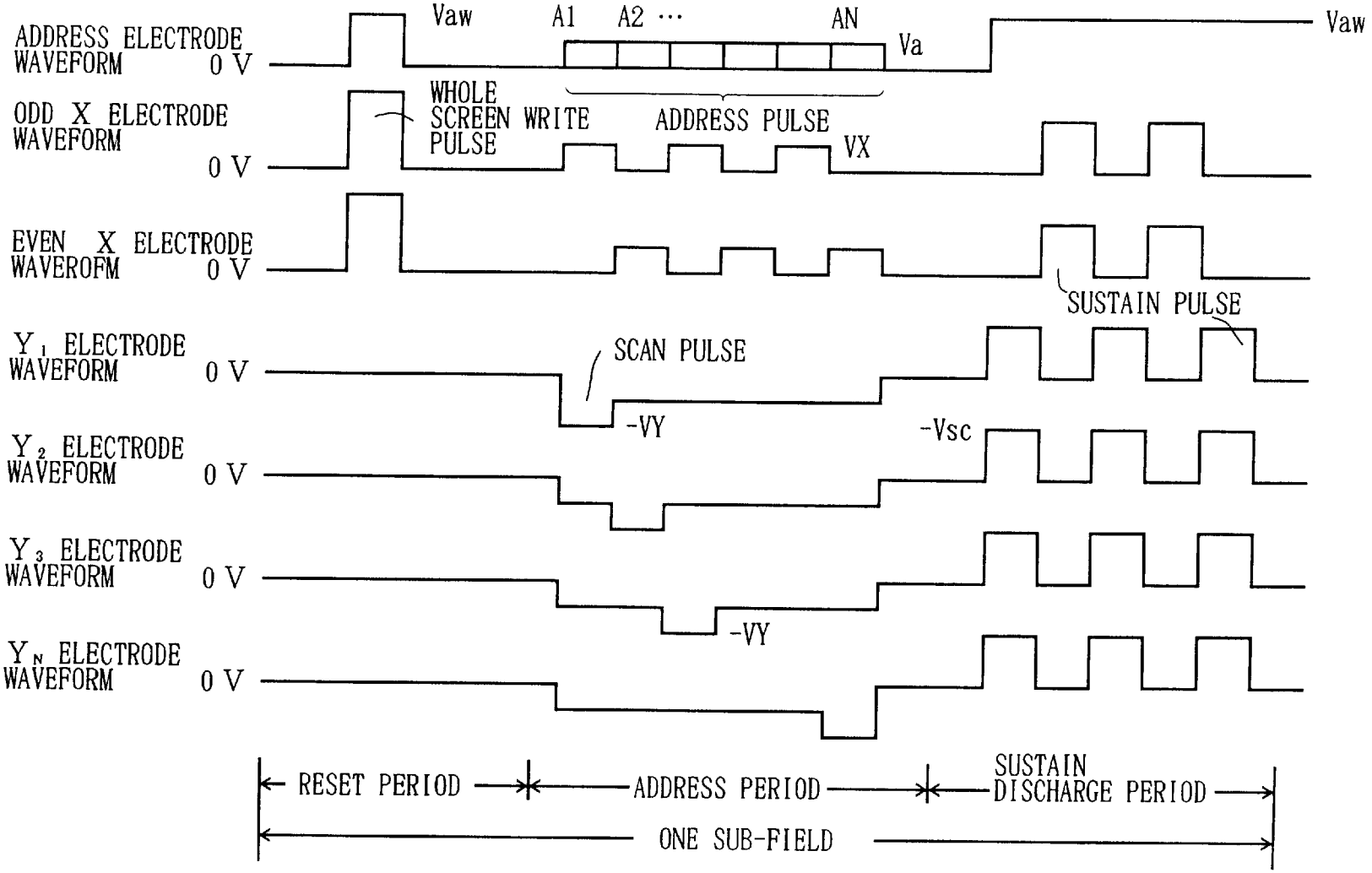
FIG. 20 is a waveform chart showing waveforms applied to the electrodes in the plasma display device of FIG. 17 in one sub-field.

FIG. 20 is a waveform chart showing the waveform applied to the electrode in the plasma display device 10 of FIG. 17 during one sub-field period. The method of operation according to the second embodiment is the separated address period/sustain discharge period write addressing. As with the conventional technology, the method of operation according to the second embodiment causes all cells on the screen to be uniform by applying thereto the voltage pulse for the whole-screen write discharge and the whole-screen self-erase during the reset period.

In the method of the operation according to the second embodiment, the address discharge is executed from the first line one by one as shown in FIG. 20 when the reset period ends and the address period is started. Initially, all the address electrodes 209 are set to 0 V, all the X electrodes 207 to 0 V, and all the Y electrodes 208 to −50 V (Vsc) When the address cycle of the first line is started, 50 V is given to the X electrode 207 and the voltage of −150 V (the voltage VY applied to the selected Y electrode 208) is applied to the Y electrode 208, respectively. The address pulse (voltage Va) of a level 50 V is applied to the address electrode 209 corresponding to the cell selected for display (luminescence and sustain discharge). On this selected cell, the discharge occurring between the address electrode 209 and the Y electrode 208 triggers the discharge between the X electrode 207 and the Y electrode 208. As a result, the negative wall charge 204 is collected on the MgO film 207D on the X electrode 207, and the positive wall charge 204 is collected on the MgO film 207D on the Y electrode 208, whereupon the discharge is extinguished. The negative wall charge 204 is formed in the fluorescent 207F on the address electrode 209.

It is now assured that the display of the first line is OFF and the address discharge is performed in the second display line. The potential of the X electrode 207 (XI electrode 207-1) not selected is maintained at 0 V in the address cycle for the second line. Therefore, the negative wall charge 204 is not formed (or formed only in a small quantity) on the XI electrode 207-1 opposite to the YI electrode 208-1 across the non-discharge slit. Therefore, the display cell formed by the XI electrode 207-1 is prevented from being lit when the sustain discharge begins.

Subsequent address cycles are carried out until addressing for all the display lines is completed.

When the addressing is completed, the sustain discharge period is initiated. The sustain discharge is performed only in those cells in which the wall discharge 204 is collected as a result of the address discharge. The sustain discharge is repeated a predetermined number of times in order for a sequence for one sub-field to be completed.

As described before, the voltage of the selected X electrode 207 is made different from that of the non-selected X electrode 207. No wall charge 204 is collected in the line adjacent to the target line. The potential difference (150 V) between the potential (150 V) of the selected Y electrode and the potential of the adjacent non-selected X electrode 207 is smaller than the minimum sustain discharge voltage Vsm in the non-discharge slit. Therefore, no discharge occurs even when the space charge is propagated to the non-discharge slit. The entire address period is divided into a first half and a second half, so that the ever lines and the odd lines are independently addressed. This arrangement has an effect of reducing the power consumed when the X electrode 207 is selected, preventing a vertical connection between the adjacent cells, and enabling a proper display with no misaddressing.

Since the pulse for selecting the X electrode 207 has the same polarity and voltage level as the address pulse (voltage Va) applied to the address electrode 209, the power consumption can be reduced and the necessary circuitry can be prepared easily. Since the scan driver is provided for the X electrode 207, a more efficient operation is enabled.

A description will now be given of a third embodiment.

Figure 21:
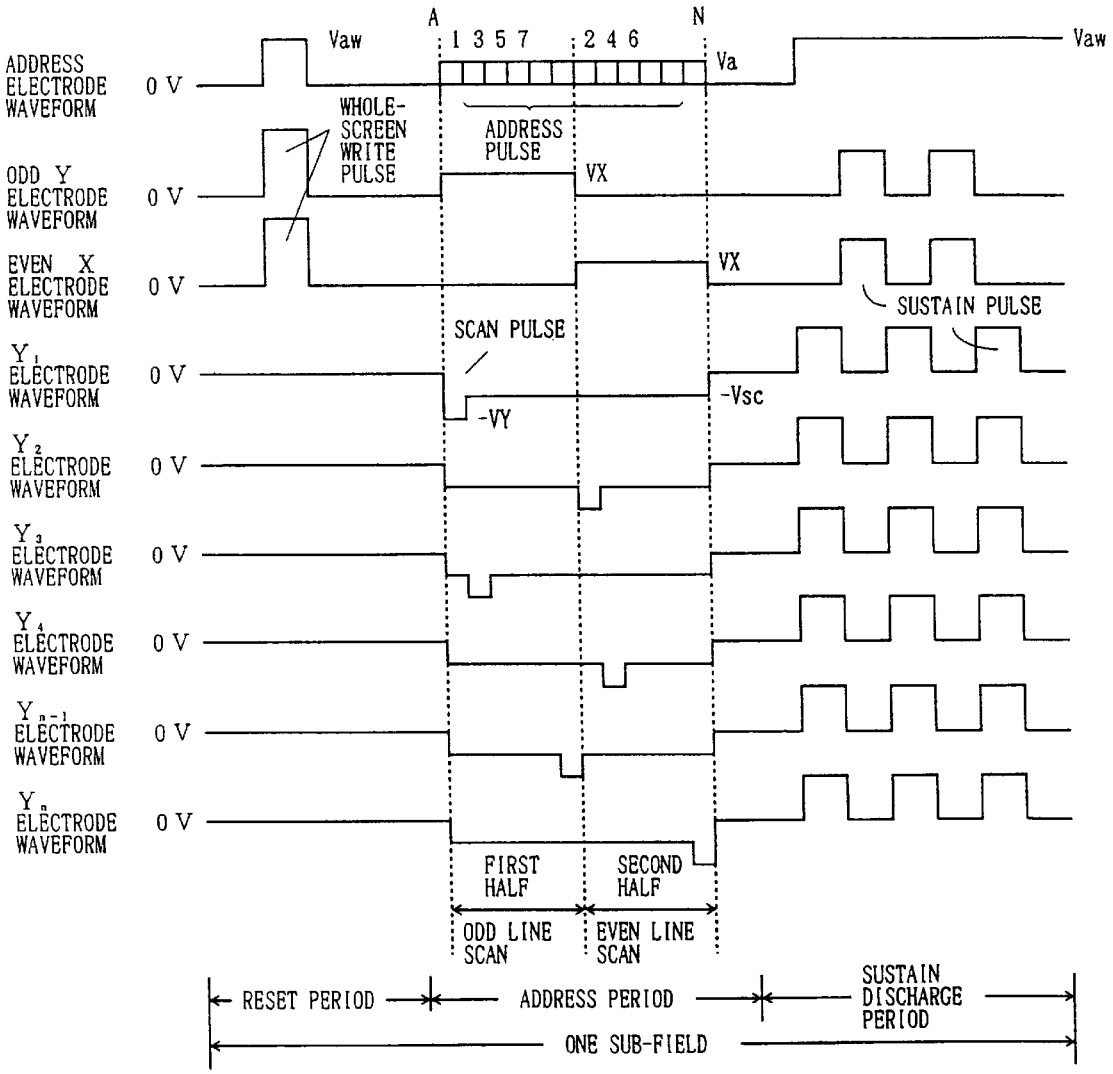
FIG. 21 is a waveform chart showing waveforms applied in on sub-field to the electrodes in the plasma display device according to a third embodiment in which the triple-electrode surface-discharge AC plasma display panel having the Y-X-Y-X array electrode structure is used.

FIG. 21 is a waveform chart of the voltage applied during one sub-field to the electrodes in the plasma display device 10 according to the third embodiment in which the triple-electrode surface-discharge AC plasma display panel 2 having the Y-X-Y-X array electrode structure is used. Those elements that are the same as the elements of the first and second embodiments described above are designated by the same reference numerals and the description thereof is omitted.

In the plasma display device 10 according to the second embodiment, a sequential addressing in the odd lines may cause the voltage VX to be applied to the X electrode 207 not selected for display even though such an electrode belongs to the odd display lines, resulting in a large power consumption due to the charging between the associated electrodes. The same is true of the even display lines.

In the plasma display device 10 according to the third embodiment operated using the circuit shown in FIGS. 5 and 17, the odd display lines are first subject to sequential addressing, and then the even display lines are subject to sequential addressing. That is, the address period for the odd display lines are made independent from the address period for the even display lines. As a result, unnecessary switching actions are prevented from occurring and the power consumption can be reduced.

As described before, the voltage of the selected X electrode 207 is made different from that of the non-selected X electrode 207. No wall charge 204 is collected in the line adjacent to the target line. The potential difference (150 V) between the potential (150 V) of the selected Y electrode and the potential of the adjacent non-selected X electrode 207 is smaller than the minimum sustain discharge voltage Vsm in the non-discharge slit. Therefore, no discharge occurs even when the space charge is propagated to the non-discharge slit. The entire address period is divided into a first half and a second half, so that the even lines and the odd lines are independently addressed. This arrangement has an effect of reducing the power consumed when the X electrode 207 is selected, preventing a vertical connection between the adjacent cells, and enabling a proper display with no misaddressing.

Since the pulse for selecting the X electrode 207 has the same polarity and voltage level as the address pulse (voltage Va) applied to the address electrode 209, the power consumption can be reduced and the necessary circuitry can be prepared easily. Since the scan driver is provided for the X electrode 207, a more efficient operation is enabled.

A description will now be given of a fourth embodiment.

Figure 22:
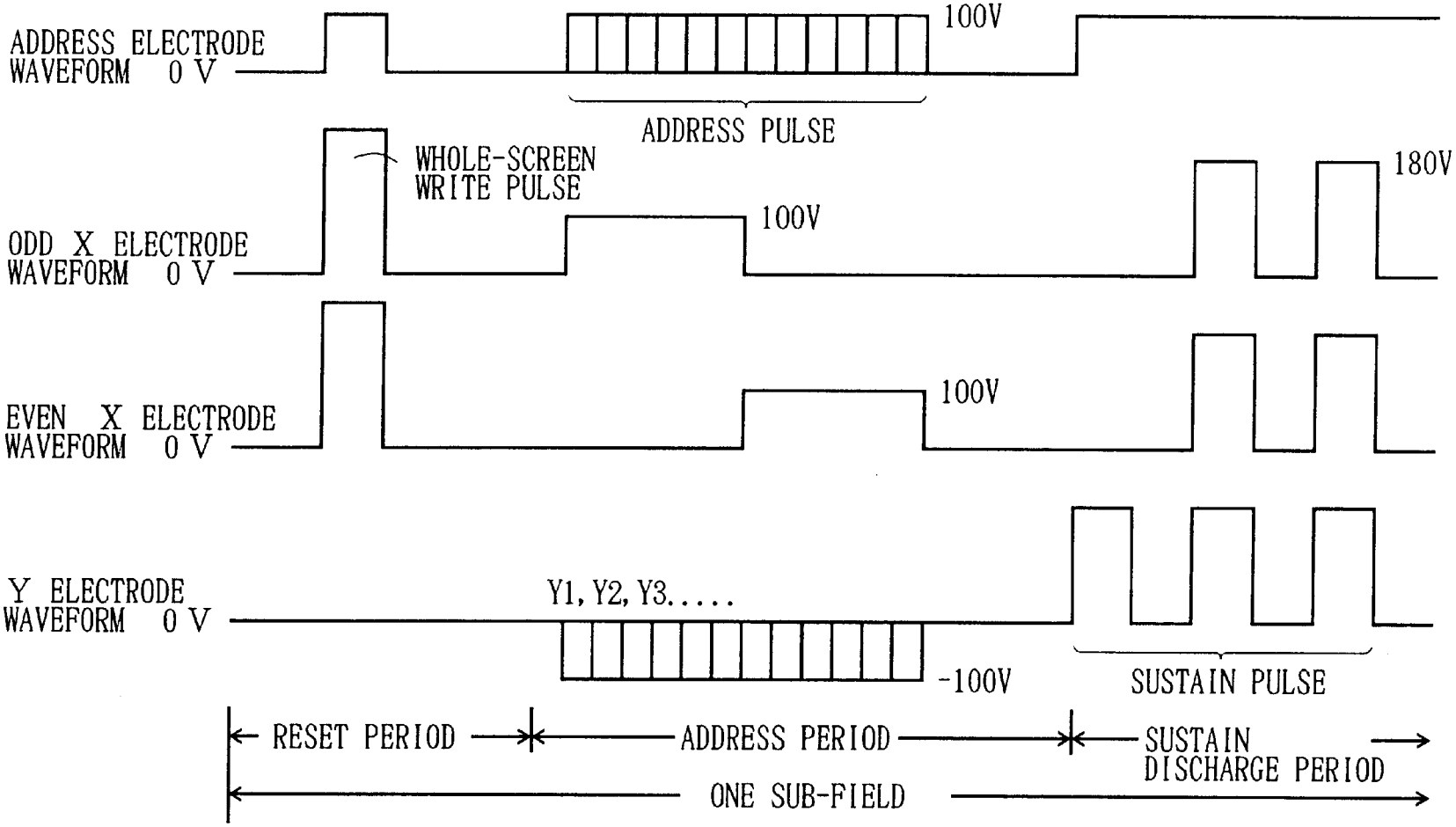
FIG. 22 is a waveform chart showing waveforms applied in one sub-field to the electrodes in the plasma display device according to a fourth embodiment in which the triple-electrode surface-discharge AC plasma display panel having the Y-X-Y-X array electrode structure is used.

FIG. 22 is a waveform chart of the voltage applied during one sub-field to the electrodes in the plasma display device 10 according to the fourth embodiment in which the triple-electrode surface-discharge AC plasma display panel 2 having the Y-X-Y-X array electrode structure is used. Those elements that are the same as the elements of the first through third embodiments described above are designated by the same reference numerals and the description thereof is omitted.

In the plasma display device 10 according to the fourth embodiment, the non-selection potential applied to the X electrode 207, the Y electrode 208 and the address electrode 209 during the address period is controlled to 0 V. The address pulse applied to the address electrode 209 is controlled to 100 V, the X selection potential is controlled to 100 V, and the scan pulse for the Y electrode 208 is controlled to −100 V. Since the potential for the non-selected electrodes is set to 0 V and the selection potentials are controlled to the same absolute level of amplitude with respect to the reference level of 0 V, no unfavorable effect is caused in the cells which are not activated.

As described before, the voltage of the selected X electrode 207 is made different from that of the non-selected X electrode 207. No wall charge 204 is collected in the line adjacent to the target line. The potential difference (150 V) between the potential (150 V) of the selected Y electrode and the potential of the adjacent non-selected X electrode 207 is smaller than the minimum sustain discharge voltage Vsm in the non-discharge slit. Therefore, no discharge occurs even when the space charge is propagated to the non-discharge slit. The entire address period is divided into a first half and a second half, so that the even lines and the odd lines are independently addressed. This arrangement has an effect of reducing the power consumed when the X electrode 207 is selected, preventing a vertical connection between the adjacent cells, and enabling a proper display with no misaddressing.

Since the pulse for selecting the X electrode 207 has the same polarity and voltage level as the address pulse (voltage Va) applied to the address electrode 209, the power consumption can be reduced and the necessary circuitry can be prepared easily. Since the scan driver is provided for the X electrode 207, a more efficient operation is enabled.

A description will now be given of a fifth embodiment.

Figure 23:
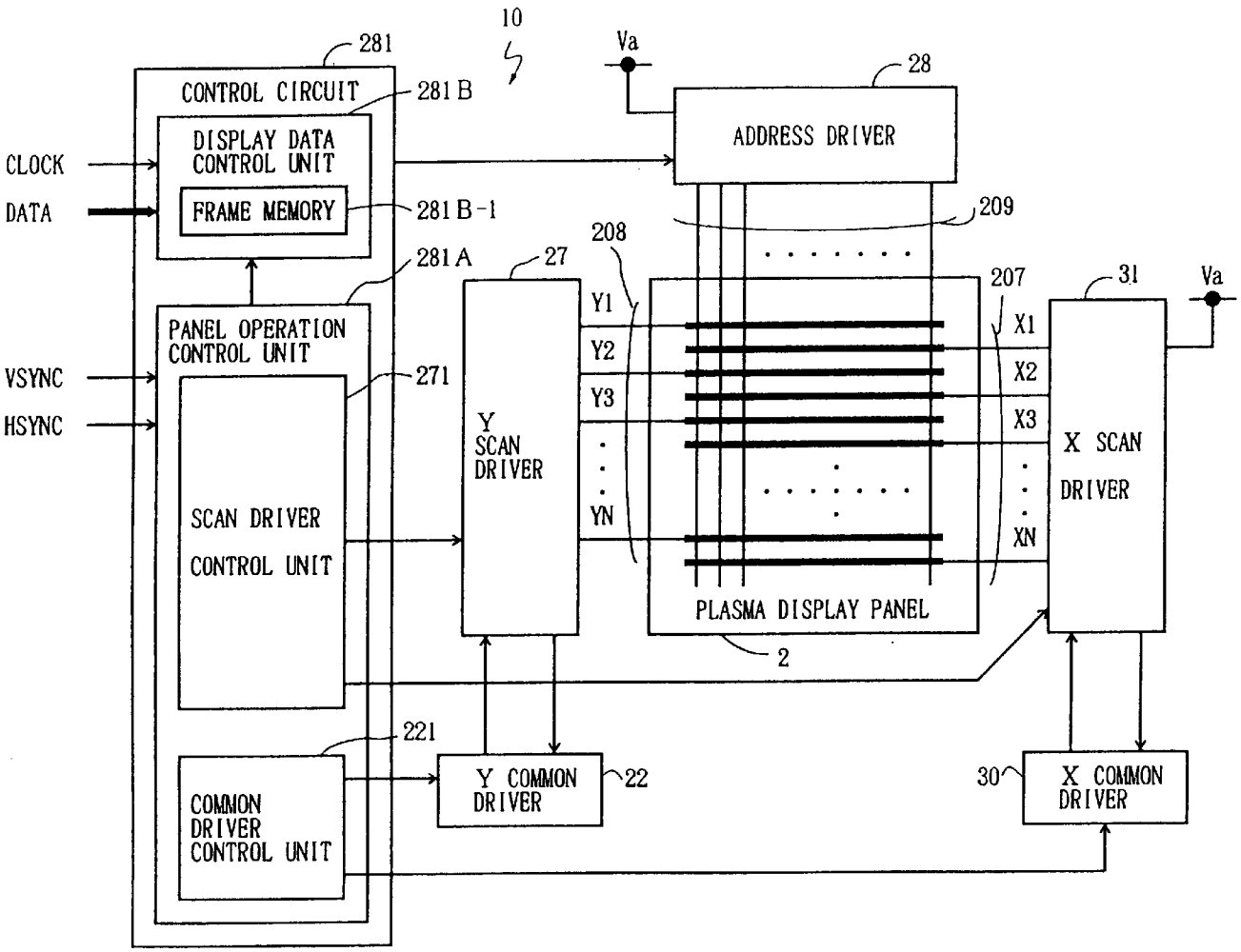
FIG. 23 is a block diagram showing a main part of a circuit for operating the plasma display device according to a fifth embodiment in which the triple-electrode surface-discharge AC plasma display panel having the Y-X-Y-X array electrode structure is used.

FIG. 23 is a block diagram of a main part of a driving circuit in the plasma display device 10 according to the fifth embodiment in which the triple-electrode surface discharge AC plasma display panel 2 having the Y-X-Y-X array electrode structure is used. Those elements that are the same as the elements of the first through fourth embodiments described above are designated by the same reference numerals and the description thereof is omitted.

The plasma display device 10 of FIG. 23 differs from the plasma display device of FIGS. 5 and 17 in that the x electrode 207 is operated by the X scan driver 31 (first electrode operating means). The X electrodes 207 in respective display lines are independently connected to the X scan driver 31 and also to the X common driver 30. The Y electrodes 208 are connected to the Y scan driver (second electrode operating means) and the Y common driver 22 (second electrode operating means).

In synchronism with the selection of the display line using the Y scan driver 27, the selection potential VX may be applied by the X scan driver 31 to the X electrode 207.

In the fourth embodiment, the selection potential has the same voltage of 50 V as the address pulse applied to the address electrode 209.

Figure 24:
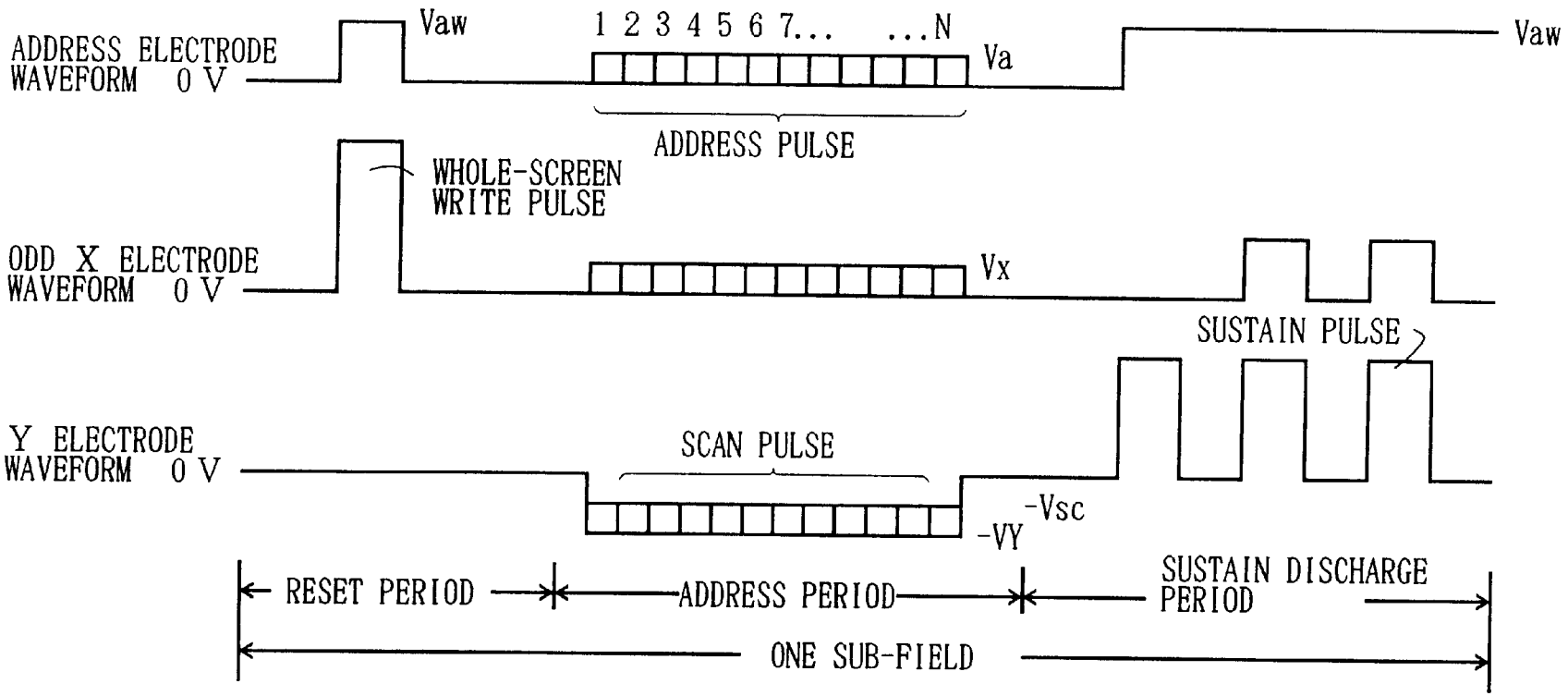
FIG. 24 is a diagram showing waveforms applied to the electrodes in the plasma display device of FIG. 23 during one sub-field.

FIG. 24 is a waveform chart of a voltage applied during one sub-field to the electrodes in the plasma display device 10 of FIG. 23.

The addressing in the first display lines is performed such that a scan pulse of VY (−150 V) is applied to the Y electrode 208-1 selected for display. At the same as this, an X scan pulse of VX (50 V) is applied to the X1 electrode 207-1. The X electrode 207 of the non-selected display line is maintained at 0 V.

As described before, the voltage of the selected X electrode 207 is made different from that of the non-selected X electrode 207. No wall charge 204 is collected in the line adjacent to the target line. The potential difference (150 V) between the potential (150 V) of the selected Y electrode and the potential of the adjacent non-selected X electrode 207 is smaller than the minimum sustain discharge voltage Vsm in the non-discharge slit. Therefore, no discharge occurs even when the space charge is propagated to the non-discharge slit. Since the pulse for selecting the X electrode 207 has the same polarity and voltage level as the address pulse (voltage Va) applied to the address electrode 209, the power consumption can be reduced and the necessary circuitry can be prepared easily. Since the scan driver is provided for the x electrode 207, a more efficient operation is enabled.

A description will now be given of a sixth embodiment.

Figure 25:
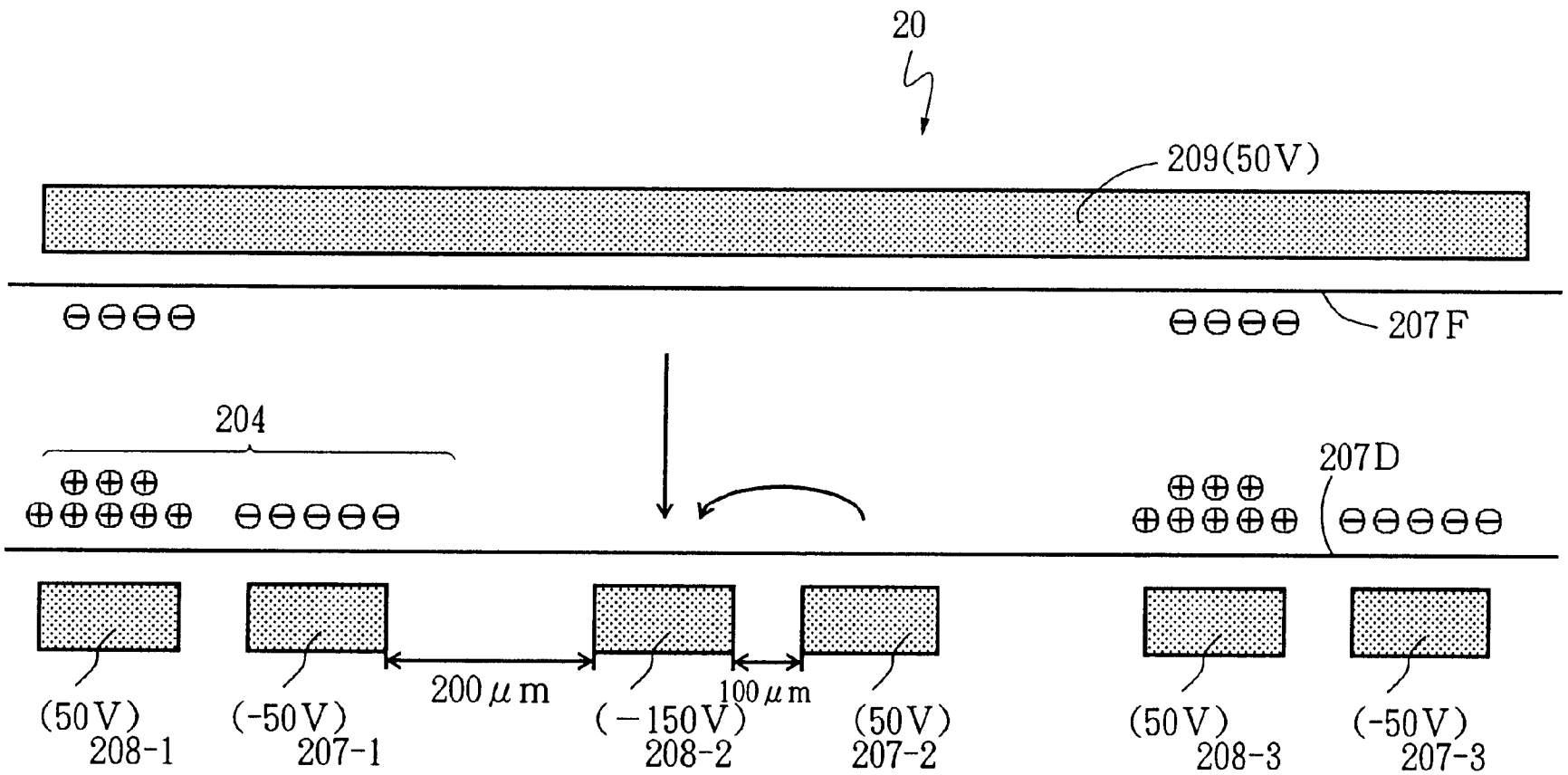
FIG. 25 is a diagram which explains the mechanism of the address discharge in the method of operation according to a sixth embodiment.
Figure 26:
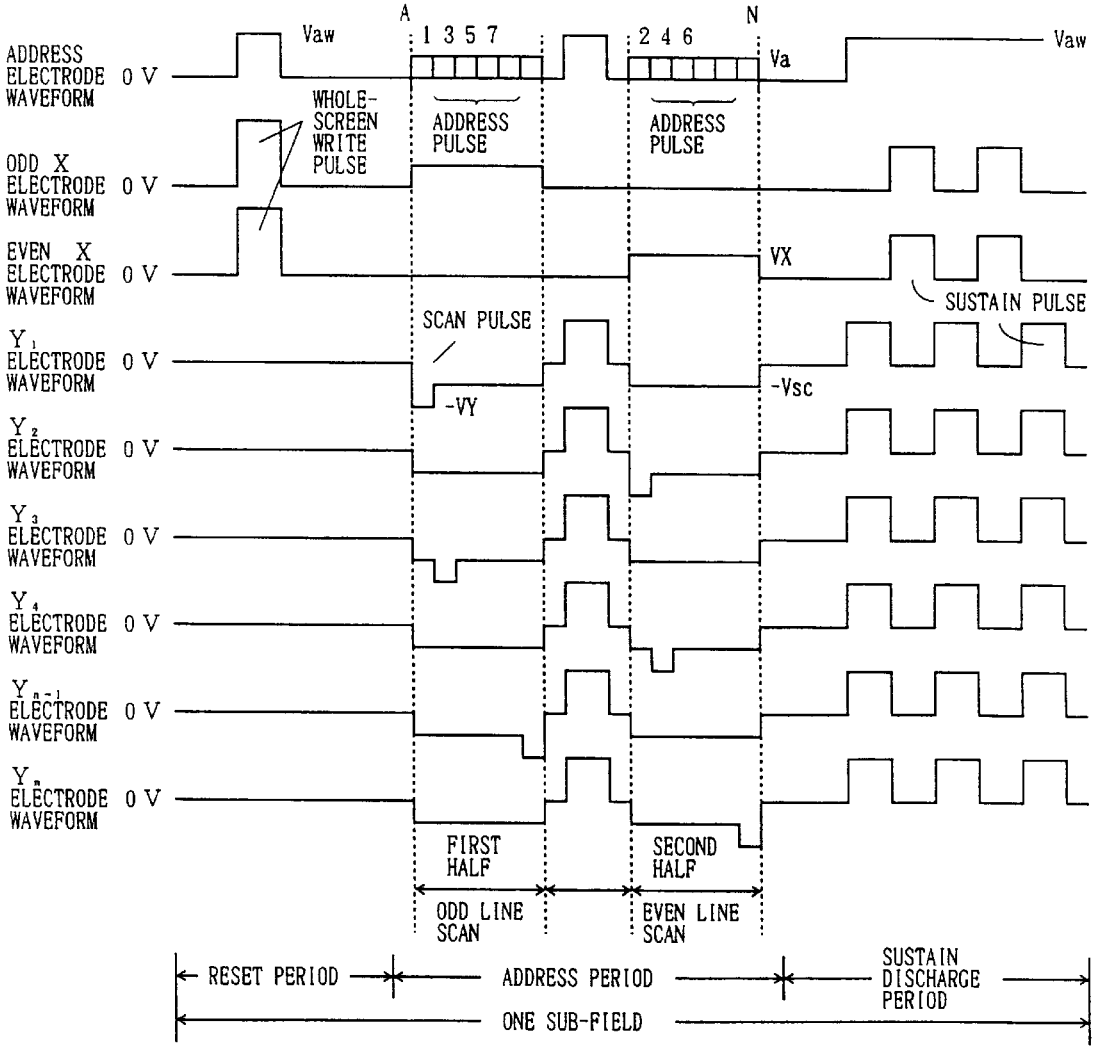
FIG. 26 is a waveform chart showing waveforms applied in on sub-field to the electrodes in the plasma display device according to the sixth embodiment in which the triple-electrode surface-discharge AC plasma display panel having the Y-X-Y-X array electrode structure is used.

FIG. 25 shows a mechanism of address discharge according to the method of operation of the sixth embodiment. FIG. 26 is a waveform chart of the voltage applied during one sub-field to the electrodes in the plasma display device 10 according to the sixth embodiment in which the triple-electrode surface-discharge AC plasma display panel 2 having the Y-X-X-Y array electrode structure is used. Those elements that are the same as the elements of the first through fifth embodiments described above are designated by the same reference numerals and the description thereof is omitted.

According to the method of operation of the sixth embodiment, the odd display lines are sequentially selected for address discharge in the first half of the address period. When the address discharge is completed for all the odd display lines, the sustain pulse (sustain discharge voltage Vs) is applied to the Y electrode 208. As a result of the sustain discharge in the odd display lines, the wall charge 204 of an inverse polarity is formed in the cells forming the odd display lines (see FIG. 25). Thereafter, in the second half of the address period, the address discharge is performed in the even display lines. Since the wall charge 204 on the Y electrode 208 forming the odd display lines is negative, no discharge occurs between the adjacent Y electrodes 208 one forming the odd display line and the other forming the even display line.

The present invention is not limited to the above described embodiments, and variations and modifications may be made without departing from the scope of the present invention.

What is claimed is:

1. A method of operating a plasma display panel provided with first electrode arrays arranged in rows, each thereof formed of a pair of first and second electrodes, and second electrode arrays arranged in columns, each thereof formed of a third electrode, each of the first and second arrays being sandwiched between substrates, display cells being formed at crosspoints of respective first and second electrodes, an address discharge process for writing information by applying a pulse to a selected second electrode and a selected third electrode , and the written information being displayed by a sustain discharge produced by applying, in accordance with the information written as a result of the address discharge process, a sustain pulse to the first and second electrodes, the method comprising:

controlling the address discharge process such that a potential difference provided by a selection potential for the first electrode and occurring across a second gap between the first and second electrodes selected for the sustain discharge, is greater than a potential difference provided by a non-selection potential for the first electrode and occurring across a first gap between the first and second electrodes not selected for the sustain discharge.

2. The method of operating a plasma display panel as recited in claim 1, wherein the non-selection potential is controlled to be lower than a minimum sustain voltage for the first gap, when the address discharge process is produced.

3. The method of operating a plasma display panel as claimed in claim 1, wherein, in a first half of an address discharge process, one of even display lines and odd display lines are selected for display by selecting corresponding ones of the second electrodes and, in a second half of the address discharge process, the other of the even display lines and the odd display lines are selected for display, and in the first half of the address discharge process, the first electrodes for the one of the even display lines and the odd display lines are set to the selection potential and the first electrodes for the other of the even display lines and the odd display lines are set to the non-selection potential and, in the second half of the address discharge process, the first electrodes for the other of the even display lines and the odd display lines are set to the selection potential and the first electrodes for the one of the even display lines and the odd display lines are set to the non-selection potential.

4. The method of operating a plasma display panel as claimed in claim 1, wherein a pulse supplied to the first electrode for a selected display cell is positive with respect to a ground potential, a pulse supplied to the second electrode for the selected display cell is negative with respect to the ground potential, and a pulse supplied to the third electrode for the selected display cell is positive with respect to the ground potential.

5. The method of operating a plasma display panel as claimed in claim 4, wherein a voltage supplied to the first electrode for the selected display cell is equal to a voltage supplied to the third electrode for the selected display cell.

6. The method of operating a plasma a display panel as claimed in claim 4, wherein a voltage supplied to the first electrode for the display cell not selected is equal to a voltage supplied to the third electrode for the display cell not selected.

7. The method of operating a plasma display panel as claimed in claim 6, wherein the voltage supplied to the first electrode for the display cell not selected and the voltage supplied to the third electrode for the display cell not selected are set to the ground potential.

8. The method of operating a plasma display panel as claimed in claim 4, wherein a selection potential difference, having approximately half the magnitude of a potential difference between the second electrode and the third electrode applied in the address discharge process, is applied to the first electrode, and a scan pulse having approximately half the magnitude of the selection potential difference is applied to the second electrode forming the selected cell.

9. The method of operating a plasma display panel as claimed in claim 4, wherein respective voltages supplied to the first electrode, the second electrode and the third electrode in the address discharge process are set to the ground potential.

10. The method of operating a plasma display panel as claimed in claim 1, wherein the selection potential is supplied to the first electrode in synchronism with an application of the scan pulse to the second electrode, when the display lines are sequentially selected one by one in the address discharge process.

11. A plasma display device provided with a plasma display panel, first electrode arrays arranged in rows, each thereof formed of a pair of first and second electrodes, and second electrode arrays arranged in columns, each thereof formed of a third electrode, each of the first and second arrays being sandwiched between substrates, display cells being formed at crosspoints of the electrodes of respective electrodes of the two arrays, wherein an address discharge process writes information by applying a pulse to a selected second electrode and a selected third electrode, and the written information is displayed by a sustain discharge produced by applying, in accordance with the information written as a result of the address discharge process, a sustain pulse to the first and second electrodes forming the display cell, the plasma display device comprising:

first electrode operating unit controlling the address discharge process such that a potential difference, provided by a selection potential for the first electrode and occurring across a second gap between the first and second electrodes selected for the sustain discharge, is greater than a potential difference provided by a non-selection potential for the first electrode and occurring across a first gap between the first and second electrodes not selected for the sustain discharge.

12. A plasma display device as recited in claim 11, wherein: the non-selection potential is lower than the selection potential.

13. A plasma display device, comprising:

a plasma display panel having:

first electrode arrays arranged in rows, each formed of a pair of first and second electrodes, second electrode arrays arranged in columns, each formed of a third electrode, each of the first and second arrays being sandwiched between substrates, display cells being formed at the crosspoints of the respective electrodes of the two arrays;

a first gap between the second electrode selected for a sustain discharge and the first electrode not selected for a sustain discharge, which is wider than a second gap between the first and second electrodes selected for a sustain discharge; and a first electrode operating circuit having:

a first selection driver, in a first half of an address discharge process, supplying the first electrodes for even display lines with a first one of a selection potential and a non-selection potential, a second selection driver, in a second half of the address discharge process, supplying the first electrodes for odd display lines with a second one of the selection potential and the non-selection potential, and a common driver supplying a sustain pulse to all the first electrodes in the sustain discharge following the address discharge process.

14. The plasma display device as claimed in claim 13, wherein the first selection driver and the second selection driver comprise respective switching elements.

15. The plasma display device as claimed in claim 13, wherein each of the first selection driver and the second selection driver comprises:

a first switching element supplying the selection potential to the first electrode;

a second switching element switching a potential of the first electrode to the selection potential; and a third switching element fixing a potential of the first electrode to the non-selection potential.

16. The plasma display device as claimed in claim 12, wherein the common driver has a current draw-in path and a current supply path which are separate from each other, each of the current draw-in path and the current supply path being connected to the first selection driver, the second selection driver and the first electrodes.

17. The plasma display device as claimed in claim 15, further comprising:

first and second diodes connected to the current supply path of the common driver in a forward arrangement with respect to the first electrodes;

third and fourth diodes connected to the current draw-in path in a reverse arrangement with respect to the first electrodes;

a first selection circuit connected to a node between the first and third diodes and the first electrodes; and a second selection circuit connected to a node between the second and fourth diodes and the first electrodes.

18. The plasma display device as claimed in claim 12, wherein:

the selection driver supplies a voltage, lower than a voltage supplied to the first electrode adjacent to the second gap, to the first electrode adjacent to the first gap and adjacent to the second electrode selected for the address discharge process.

19. The plasma display device as claimed in claim 13, wherein:

in a first half of the address discharge process, the selection potential is supplied to a first group of first electrodes for one of even display lines and odd display lines, using one of the first selection driver and the second selection driver, and the non-selection potential is supplied to a second group of first electrodes for the other of the even display lines and the odd display lines, using the other of the first and second selection drivers;

the address discharge process is sequentially executed in the first group of first electrodes, whereupon the non-selection potential is supplied to the first group of first electrodes, and the selection potential is supplied to a second group of first electrodes so that the address discharge process is executed in the second group of first electrodes; and the sustain pulse is supplied from the common driver to all the first electrodes in the plasma display device, producing a sustain discharge and an illuminated display on the plasma display panel.

20. The plasma display device as claimed in claim 12, further comprising a power source for the first selection driver, the second selection driver and an address driver operating the third electrode.

21. The plasma display device as claimed in claim 12, wherein the first gap between the second electrode selected for the sustain discharge and the first electrode not selected for the sustain discharge is twice as wide as the second gap between the first and second electrodes selected for the sustain discharge.

22. A plasma display device provided with a plasma display panel, first electrode arrays arranged in rows, each thereof formed of a pair of first and second electrodes, and second electrode arrays arranged in columns, each thereof formed of a third electrode, each of the first and second arrays being sandwiched between substrates, display cells being formed at the crosspoints of the electrodes of the two arrays, wherein a first gap, between the first and second electrodes, not selected for the sustain discharge is wider than a second gap, between the first and second electrodes, selected for the sustain discharge, an address discharge process writing information by applying a pulse to the second electrode and the third electrode, and the information is displayed by a sustain discharge process caused by applying, in accordance with the information written as a result of the address discharge process, a sustain pulse to the first and second electrodes forming the display cell, the plasma display device comprising:

a scan driver supplying a selection potential and a non-selection potential selectively to the second electrodes; and a common driver supplying a sustain pulse to all the second electrodes in the sustain discharge process following the address discharge process.

23. The plasma display device as claimed in claim 22, wherein a power source supplying power to the scan driver for operating the second electrodes also supplies power to an address driver for operating the third electrodes.

24. The plasma display device as claimed in claim 21, wherein the first gap, between the first and second electrodes, not selected for the sustain discharge does not exceed twice the width of the second gap, between the first and second electrodes, selected for the sustain discharge.

25. A method of operating a plasma display panel provided with first electrode arrays arranged in rows, each thereof formed of a pair of first and second electrodes, and with second electrode arrays arranged in columns, each thereof formed of a third electrode, each of the first and second arrays being sandwiched between substrates, display cells being formed at the crosspoints of respective electrodes of the two arrays, the first and second electrodes having an alternately opposite disposition from one display line to another, a first gap between the first or between the second electrodes not selected for the sustain discharge being wider than a second gap between the first and second electrodes selected for the sustain discharge, an address discharge process for writing information by applying a pulse to the second electrode and the third electrode, and the information being displayed by a sustain discharge produced by applying, in accordance with the information written as a result of the address discharge process, a sustain pulse to the first and second electrodes forming selected cell, the method comprising:

in a first half of the address discharge process, sequentially executing the address discharge process in one group of second electrodes for one of even display lines and odd display lines, and thereupon applying the sustain pulse to the electrodes;

in an interim between the first half of the address discharge process and a second half thereof, producing the sustain discharge in the cells in which the address discharge was caused during the first half of the address discharge process;

in a second half of the address discharge process, sequentially executing the address discharge process in the other group of second electrodes for the other of the even display lines and the odd display lines; and in a last phase, alternately applying the sustain pulse to all of the first and second electrodes to produce the sustain discharge.

26. The method of operating a plasma display panel as claimed in claim 24, wherein the sustain pulse applied in the interim between the first half of the address discharge process and the second half thereof has an opposite waveform with respect to a waveform of a voltage applied to the first and second electrodes in the address discharge process.

27. The method of operating a plasma display panel as claimed in claim 24, wherein the sustain pulse applied in the interim between the first half of the address discharge process and the second half thereof, and the sustain pulse applied in the last phase have an opposite pulse waveform with respect to a waveform of a voltage applied to the first and second electrodes in the address discharge process.

28. A plasma display device provided with first electrode arrays arranged in rows, each thereof formed of a pair of first and second electrodes and second electrode arrays arranged in columns, each thereof formed of a third electrode, each of the first and second arrays being sandwiched between substrates, display cells being formed at the crosspoints of the electrodes of the two arrays, the first and second electrodes having an alternately opposite disposition from one display line to another, a first gap between the first or between the second electrodes not selected for the sustain discharge being wider than a second gap between the first and second electrodes selected for the sustain discharge, an address discharge process for writing information by applying a pulse to the second electrode and the third electrode, and the information being displayed by a sustain discharge produced by applying, in accordance with the information written as a result of the address discharge process, a sustain pulse to the first and second electrodes forming the display cell, the plasma display device comprising:

an operating unit operating the plasma display panel in accordance with:

in a first half of the address discharge process, sequentially executing the address discharge process in one group of second electrodes for one of even display lines and odd display lines, and thereupon applying the sustain pulse to the electrodes, in an interim between the first half of the address discharge process and a second half thereof, producing a sustain discharge in the cells in which the address discharge was produced during the first half of the address discharge process, and in a second half of the address discharge process, sequentially executing the address discharge process in the other group of second electrodes for the other of the even display lines and the odd display lines; and a sustain discharge unit alternately applying the sustain pulse to all the first and second electrodes to produce the sustain discharge.

29. The plasma display device as claimed in clam 28, wherein a gap between the first electrodes not selected for the sustain discharge is one to two times as long as a gap between the first electrodes and the second electrodes selected for the sustain discharge, and a gap between the second electrodes not selected for the sustain discharge is one to two times as long as a gap between the first electrodes and the second electrodes selected for the sustain discharge.

30. A plasma display device, comprising:

a triple electrode plane-discharge plasma display panel comprising first and second substrates having first and second electrode arrays respectively disposed thereon in spaced relationship with a discharge space therebetween, the first electrode array comprising plural rows, each row comprising a pair of first and second electrodes, and the second electrode array comprising plural columns, each column comprising a third electrode, cross-points of the electrodes of the first and second arrays defining corresponding display cells; and an addressing circuit selecting a cell of a selected row in an addressing process by applying a selection potential between the respective pair of second and third electrodes defining the cell and providing a non-selection potential, which potential is lower than a minimum sustain discharge voltage of a display cell, to the electrode, of the respective pair of the first and second electrodes of the adjacent row, closest to the selected row.

31. A plasma display device as recited in claim 29, further comprising:

a common driver supplying a sustain pulse all the first electrodes in a sustain discharge process, following the addressing process.

32. A plasma display device as recited in claim 30, further comprising:

a controller defining first and second halves of the addressing process and, further:

in a first half of the addressing process, sequentially executing the addressing process in one group of second electrodes for one of even display lines and odd display lines, and thereupon applying the sustain pulse to the electrodes, in an interim between the first half of the addressing process and the second half thereof, producing a sustain discharge in each cell in which an address discharge was produced during the first half of the addressing process, and in a second half of the addressing process, sequentially executing the addressing process in the other group of second electrodes for the other of the even display lines and the odd display lines.

33. A method of operating a triple electrode plane-discharge plasma display panel comprising first and second substrates having first and second electrode arrays respectively disposed thereon in spaced relationship with a discharge space therebetween, the first electrode array comprising plural columns, each column comprising a pair of first and second electrodes, and the second electrode array comprising plural rows, each row comprising a third electrode, cross-points of the electrodes of the first and second arrays defining corresponding display cells, the method comprising:

selecting a cell of a selected row in an addressing process by applying a selection potential between the respective pair of second and third electrodes defining the cell; and providing a non-selection potential, which potential is lower than a minimum sustain discharge voltage of a display cell, to the electrode, of the respective pair of the first and second electrodes of the adjacent row, closest to the selected row.

34. A method as recited in claim 32, further comprising:

supplying a sustain pulse all the first electrodes in a sustain discharge process, following the addressing process.

35. A method as recited in claim 33, further comprising:

in a first half of the addressing process, sequentially executing the addressing process in one group of second electrodes for one of even display lines and odd display lines, and thereupon applying the sustain pulse to the electrodes, in an interim between the first half of the addressing process and a second half thereof, producing a sustain discharge in each cell in which an address discharge was produced during the first half of the addressing process, and in a second half of the addressing process, sequentially executing the addressing process in the other group of second electrodes for the other of the even display lines and the odd display lines.

* * * * *

UNITED STATES PATENT AND TRADEMARK OFFICE

CERTIFICATE OF CORRECTION

PATENT NO. : 6,140,984
DATED : October 31, 2000
INVENTOR(S) : Yoshikazu Kanazawa et al.

It is certified that error appears in the above-identified patent and that said Letters Patent is hereby corrected as shown below:

Column 22,
Line 13, delete "the electrodes of";
Line 16, delete ",";
Lines 20-21, delete "forming the display cell";
Line 22, before "first" insert -- a --;
Line 33, begin a new paragraph with "the non-selection"

Column 23,
Line 14, change "claim 15" to -- claim 16 --;
Line 57, change "claim 12" to -- claim 13 --;
Line 62, change "claim 12" to -- claim 13 --.

Column 24,
Line 27, after "process" insert -- , --;
Line 33, change "claim 21" to -- claim 22 --.

Column 25,
Line 9, change "claim 24" to -- claim 25 --;
Line 15, change "claim 24" to -- claim 25 --.

Column 26,
Line 20, change "claim 29" to -- claim 30 --;
Line 25, change "claim 30" to -- claim 31 --;
Line 64, change "claim 32" to -- claim 33 --.

Signed and Sealed this

Twenty-fifth Day of September, 2001

*Attest:*

Nicholas P. Godici

NICHOLAS P. GODICI
*Acting Director of the United States Patent and Trademark Office*

*Attesting Officer*

UNITED STATES PATENT AND TRADEMARK OFFICE

CERTIFICATE OF CORRECTION

PATENT NO. : 6,140,984
DATED : October 31, 2000
INVENTOR(S) : Yoshikazu Kanazawa et al.

It is certified that error appears in the above-identified patent and that said Letters Patent is hereby corrected as shown below:

Column 20,
Line 60, change “first and second electrodes” to -- electrodes of the two arrays --.

Column 23,
Line 7, change “12” to -- 13 --.
Line 25, change “12” to -- 13 --.

Column 27,
Line 1, change “33” to -- 34 --.

Signed and Sealed this

Twenty-fourth Day of December, 2002

JAMES E. ROGAN
*Director of the United States Patent and Trademark Office*

UNITED STATES PATENT AND TRADEMARK OFFICE

CERTIFICATE OF CORRECTION

PATENT NO. : 6,140,984
DATED : October 31, 2000
INVENTOR(S) : Yoshikazu Kanazawa et al.

It is certified that error appears in the above-identified patent and that said Letters Patent is hereby corrected as shown below:

Drawings,
Fig. 21, should be deleted to be replaced with the corrected Fig. 21, as shown on the attached page.

Column 26,
Line 49, change “columns” to -- rows -- and change “column” to -- row --.
Line 51, change “rows” to -- columns -- and change “row” to -- column --.

Signed and Sealed this

Thirtieth Day of September, 2003

JAMES E. ROGAN
*Director of the United States Patent and Trademark Office*

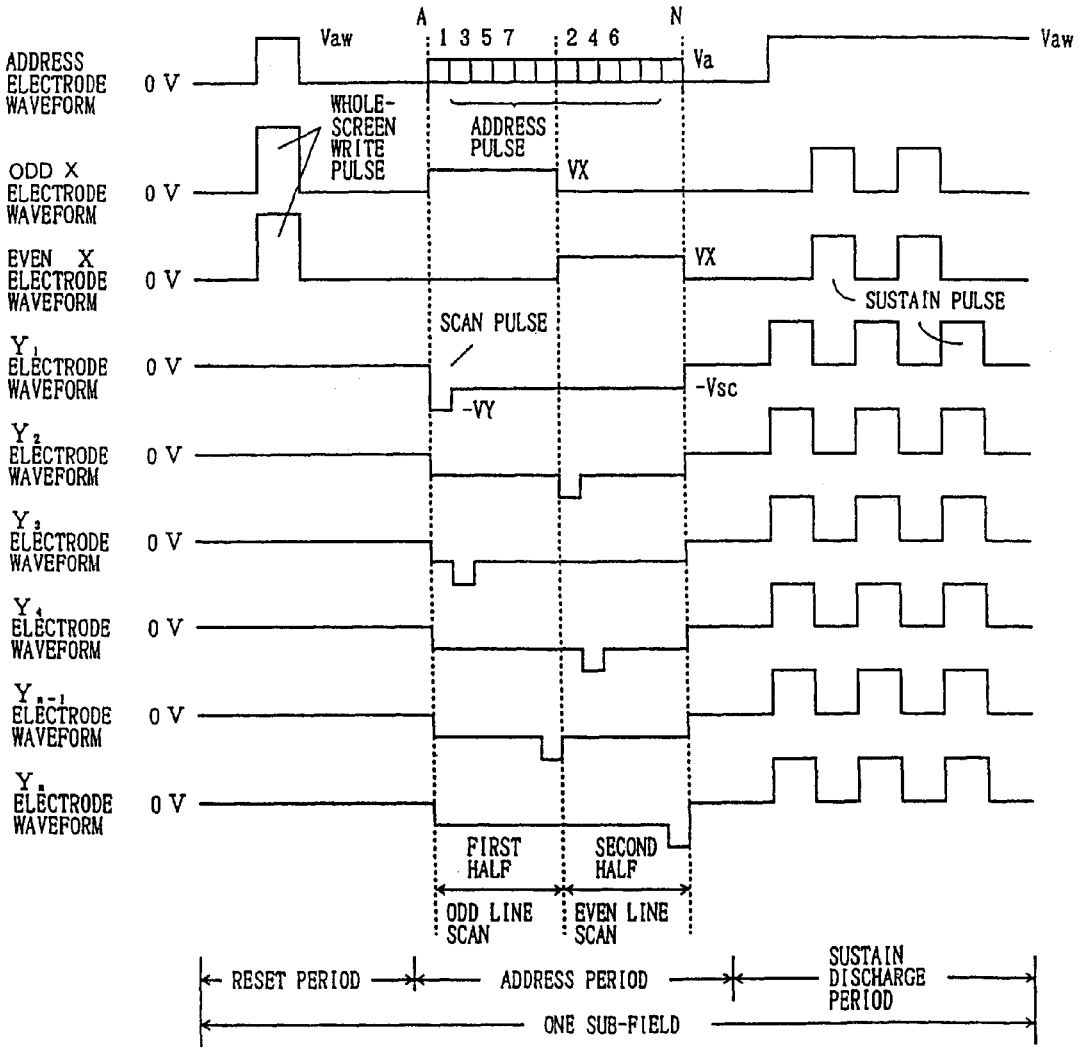
ADDRESS ELECTRODE WAVEFORM
0 V
Vaw
A
1 3 5 7
2 4 6
N
Va
Vaw
WHOLE-SCREEN WRITE PULSE
ADDRESS PULSE
ODD X ELECTRODE WAVEFORM
0 V
VX
EVEN X ELECTRODE WAVEFORM
0 V
VX
SUSTAIN PULSE
SCAN PULSE
Y1 ELECTRODE WAVEFORM
0 V
-VY
-Vsc
Y2 ELECTRODE WAVEFORM
0 V
Y3 ELECTRODE WAVEFORM
0 V
Y4 ELECTRODE WAVEFORM
0 V
Yn-1 ELECTRODE WAVEFORM
0 V
Yn ELECTRODE WAVEFORM
0 V
FIRST HALF
SECOND HALF
ODD LINE SCAN
EVEN LINE SCAN
RESET PERIOD
ADDRESS PERIOD
SUSTAIN DISCHARGE PERIOD
ONE SUB-FIELD